US006873814B2

(12) United States Patent
Ohjimi et al.

(10) Patent No.: US 6,873,814 B2
(45) Date of Patent: Mar. 29, 2005

(54) DEVELOPING DEVICE USING A TWO-INGREDIENT TYPE DEVELOPER AND IMAGE FORMING APPARATUS INCLUDING THE SAME

(75) Inventors: Tokuya Ohjimi, Kanagawa (JP); Fumihiro Sasaki, Shizuoka (JP); Hiroto Higuchi, Shizuoka (JP); Maiko Kondo, Shizuoka (JP); Toshio Koike, Kanagawa (JP); Atsushi Sampe, Kanagawa (JP); Masayuki Yamane, Kanagawa (JP); Kunihiro Ohyama, Kanagawa (JP); Junichi Sano, Kanagawa (JP); Takeyoshi Sekine, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 5 days.

(21) Appl. No.: 10/285,636

(22) Filed: Nov. 1, 2002

(65) Prior Publication Data

US 2003/0108362 A1 Jun. 12, 2003

(30) Foreign Application Priority Data

Nov. 1, 2001 (JP) ..... 2001-336692
Nov. 13, 2001 (JP) ..... 2001-347543

(51) Int. Cl.[7] ..... G03G 15/08

(52) U.S. Cl. ..... 399/252; 399/267; 430/106.1; 430/110.4

(58) Field of Search ..... 399/252, 267, 399/277; 430/106.1, 106.2, 106.3, 110.4

(56) References Cited

U.S. PATENT DOCUMENTS 4,502,412 A 3/1985 Jones
5,014,089 A * 5/1991 Sakashita et al. ..... 399/275
5,137,796 A * 8/1992 Takiguchi et al. ..... 430/110.4
5,486,443 A * 1/1996 Grande et al. ..... 430/106.2
5,618,647 A * 4/1997 Kukimoto et al. ..... 430/106.1
5,663,026 A * 9/1997 Kasuya et al. ..... 430/106.2
6,335,137 B1 1/2002 Suzuki et al.
6,337,957 B1 1/2002 Tamaki et al.
6,403,275 B1 6/2002 Kuramoto et al.
6,442,364 B2 8/2002 Kai et al.
6,468,706 B2 10/2002 Matsuda et al.
6,505,014 B2 1/2003 Aoki et al.
6,507,718 B2 1/2003 Ohjimi et al.
6,638,674 B2 * 10/2003 Komoto et al. ..... 430/106.1

FOREIGN PATENT DOCUMENTS

JP 6-332237 12/1994
JP 8-114986 5/1996

(List continued on next page.)

OTHER PUBLICATIONS

U.S. Appl. No. 10/836,264, filed May 3, 2004, Shintani et al.
U.S. Appl. No. 10/820,726, filed Apr. 9, 2004, Koike et al.

(List continued on next page.)

*Primary Examiner*—Robert Beatty
(74) *Attorney, Agent, or Firm*—Oblon, Spivak, McClelland, Maier & Neustadt, P.C.

(57) ABSTRACT

A developing device including a developer containing magnetic toner grains and includes a main pole for development disposed in a sleeve. Flux density generated by the magnetic pole in a direction normal to the surface of the sleeve outside of the surface has an attenuation ratio of 50% or above. The toner grains have a weight mean grain size of 6.0 μm to 8.0 μm while the toner grains having grain sizes of 5 μm and below occupy 40% to 80% of the entire developer. The toner grains have magnetization strength of 10 emu/g to 25 emu/g in a magnetic field of 5 kOe or magnetization strength of 7 emu/g to 20 emu/g in a magnetic field of 1 kOe. The toner grains reduce toner scattering and image defects despite that they are magnetic, thereby implementing ultrahigh resolution.

18 Claims, 24 Drawing Sheets

FOREIGN PATENT DOCUMENTS

| | | |
|---|---|---|
| JP | 9-022178 | 1/1997 |
| JP | 2000-039740 | 2/2000 |
| JP | 2000-305360 | 11/2000 |
| JP | 2000-321867 | 11/2000 |
| JP | 2001-027849 | 1/2001 |
| JP | 2001-296743 | 10/2001 |

OTHER PUBLICATIONS

U.S. Appl. No. 10/792,694, filed Mar. 5, 2004, Tsuda et al.
U.S. Appl. No. 10/759,197, filed Jan. 20, 2004, Emoto et al.
U.S. Appl. No. 10/793,320, filed Mar. 5, 2004, Higuchi et al.
U.S. Appl. No. 10/760, 452, filed Jan. 21, 2004, Higuchi et al.
U.S. Appl. No. 10/745,532, filed Dec. 29, 2003, Sano et al.
U.S. Appl. No. 10/725,402, filed Dec. 3, 2003, Shintani et al.
U.S. Appl. No. 10/724,260, filed Dec. 1, 2003, Emoto et al.
U.S. Appl. No. 10/712,026, filed Nov. 14, 2003, Tomita et al.
U.S. Appl. No. 10/666,254, filed Sep. 22, 2003, Kondo et al.
U.S. Appl. No. 10/645,804, filed Aug. 22, 2003, Tomita et al.
U.S. Appl. No. 10/661, 569, filed Sep. 15, 2003, Kosuge et al.
U.S. Appl. No. 10/652,505, filed Sep. 2, 2003, Murakami et al.
U.S. Appl. No. 10/653,097, filed Sep. 3, 2003, Kimura et al.
U.S. Appl. No. 10/631,727, filed Aug. 1, 2003, Suzuki et al.
U.S. Appl. No. 09/656,414, filed Sep. 6, 2000, unknown.
U.S. Appl. No. 09/565,539, filed May 5, 2000, allowed.
U.S. Appl. No. 09/567,982, filed May 10, 2000, allowed.
U.S. Appl. No. 09/820,609, filed Mar. 30, 2001, pending.
U.S. Appl. No. 09/873,246, filed Jun. 5, 2001, pending.
U.S. Appl. No. 09/905,872, filed Jul. 17, 2001, pending.
U.S. Appl. No. 09/943,505, filed Aug. 31, 2001, pending.
U.S. Appl. No. 09/944,076, filed Sep. 4, 2001, pending.
U.S. Appl. No. 09/965,826, filed Oct. 1, 2001, pending.
U.S. Appl. No. 09/953,922, filed Sep. 18, 2001, allowed.
U.S. Appl. No. 09/982,877, filed Oct. 22, 2001, pending.
U.S. Appl. No. 09/963,429, filed Sep. 27, 2001, allowed.
U.S. Appl. No. 09/996,585, filed Nov. 30, 2001, pending.
U.S. Appl. No. 10/041,582, filed Jan. 10, 2002, pending.
U.S. Appl. No. 10/077,813, filed Feb. 20, 2002, pending.
U.S. Appl. No. 10/077,752, filed Feb. 20, 2002, pending.
U.S. Appl. No. 10/083,159, filed Feb. 27, 2002, pending.
U.S. Appl. No. 10/086,683, filed Mar. 4, 2002, pending.
U.S. Appl. No. 10/098,591, filed Mar. 18, 2002, pending.
U.S. Appl. No. 10/151,103, filed May 21, 2002, pending.
U.S. Appl. No. 10/155,111, filed May 28, 2002, pending.
U.S. Appl. No. 10/285,636, filed Nov. 1, 2002, pending.
U.S. Appl. No. 10/788,488, filed Mar. 1, 2004, Arai et al.
U.S. Appl. No. 10/780,773, filed Feb. 19, 2004, Satoh.

* cited by examiner

YRSiX3

FIG. 16

| | NUMBER % OF 5 μm & BELOW | MAG. IN $1\times10^6/4\pi$ [A/m] FIELD | MAG. IN $5\times10^6/4\pi$ [A/m] FIELD | CARRIER COAT LAYER | FLUIDIZING AGENT |
|---|---|---|---|---|---|
| EX. 1 | 51.4 | 12.8 | 17.1 | SILICONE RESIN CARBON BLACK | HYDROPHOBIC SILICA |
| EX. 2 | 51.4 | 12.1 | 17.6 | SILICONE RESIN CARBON BLACK | HYDROPHOBIC SILICA HYDROPHOBIC TITANIUM OXIDE |
| EX. 3 | 41.2 | 13.4 | 18.1 | SILICON RESIN CARBON BLACK | HYDROPHOBIC SILICA HYDROPHOBIC TITANIUM OXIDE |
| EX. 4 | 62.1 | 12.2 | 17.3 | SILICONE RESIN CARBON BLACK | HYDROPHOBIC SILICA HYDROPHOBIC TITANIUM OXIDE |
| EX. 5 | 75.6 | 11.9 | 16.9 | SILICONE RESIN CARBON BLACK | HYDROPHOBIC SILICA HYDROPHOBIC TITANIUM OXIDE |
| EX. 6 | 55.7 | 18.7 | 24.1 | SILICONE RESIN CARBON BLACK | HYDROPHOBIC SILICA HYDROPHOBIC TITANIUM OXIDE |
| COM. EX. 1 | 32.3 | 28.9 | 37.6 | SILICONE RESIN CARBON BLACK | HYDROPHOBIC SILICA HYDROPHOBIC TITANIUM OXIDE |
| COM. EX. 2 | 63.2 | 0.1 | 0.1 | SILICONE RESIN CARBON BLACK | HYDROPHOBIC SILICA HYDROPHOBIC TITANIUM OXIDE |

FIG. 18

| | |
|---|---|
| ≪MAGNET ROLLER≫ | |
| DIAMETER | φ16mm |
| NUMBER OF POLES | 6 |
| PEAK FLUX DENSITY OF MAIN POLE | 80mT |
| ≪DEVELOPING CONDITIONS≫ | |
| DEVELOPING GAP Gp | 0.33mm |
| DOCTOR GAP Gd | 0.32mm |
| AMOUNT OF SCOOP-UP | 68mg/cm2 |
| DRUM DIAMETER | φ30mm |
| DRUM LINEAR VELOCITY | 295.2mm/sec |
| SLEEVE/DRUM VELOCITY RATIO | 2.46 |
| ≪LATENT IMAGE CONDITIONS≫ | |
| BACKGROUND POTENTIAL VD | −900v |
| IMAGE POTENTIAL VL | −100v |
| DEVELOPMENT BIAS | −700v |

FIG. 19

| DEVELOPER | NUMBER OF 5μm & BELOW | ATTEN. RATIO (%) | OMISSION | REPRODUCIBILITY OF 1,200dpi DOT | DENSITY CONTROLLABILITY | IRREGURALITY |
|---|---|---|---|---|---|---|
| EX. 1 | 51.4 | 30 | × | × | ◎ | ◎ |
| | | 40 | △ | △ | | |
| | | 50 | ○ | ○ | | |
| | | 60 | ◎ | ○ | | |
| EX. 2 | 51.4 | 30 | × | × | ◎ | ◎ |
| | | 40 | △ | △ | | |
| | | 50 | ○ | ○ | | |
| | | 60 | ◎ | ○ | | |
| EX. 3 | 41.2 | 30 | × | × | ◎ | ◎ |
| | | 40 | △ | × | | |
| | | 50 | ○ | ○ | | |
| | | 60 | ○ | ○ | | |
| EX. 4 | 62.1 | 30 | × | × | ○ | ○ |
| | | 40 | △ | △ | | |
| | | 50 | ○ | ○ | | |
| | | 60 | ◎ | ○ | | |
| EX. 5 | 75.6 | 30 | × | × | ○ | ○ |
| | | 40 | △ | △ | | |
| | | 50 | ◎ | ○ | | |
| | | 60 | ◎ | ◎ | | |
| EX. 6 | 55.7 | 30 | × | × | ○ | ○ |
| | | 40 | △ | △ | | |
| | | 50 | ○ | ○ | | |
| | | 60 | ◎ | ○ | | |
| COM. EX. 1 | 32.3 | 30 | × | × | ◎ | ◎ |
| | | 40 | × | × | | |
| | | 50 | △ | △ | | |
| | | 60 | ○ | △ | | |
| COM. EX. 2 | 63.2 | 30 | × | × | × | × |
| | | 40 | △ | △ | | |
| | | 50 | ○ | ○ | | |
| | | 60 | ◎ | ○ | | |

FIG. 20

| DEVELOPER | NUMBER OF 5μm & BELOW | ANGLE θ1 (°) | OMISSION | REPRODUCIBILITY OF 1,200 dpi DOT | DENSITY CONTROLLABILITY | IRREGULARITY |
|---|---|---|---|---|---|---|
| EX. 1 | 51.4 | 78 | × | × | ◎ | ◎ |
| | | 61 | △ | △ | | |
| | | 40 | ○ | ○ | | |
| | | 22 | ◎ | ○ | | |
| EX. 2 | 51.4 | 78 | × | × | ◎ | ◎ |
| | | 61 | △ | △ | | |
| | | 40 | ○ | ○ | | |
| | | 22 | ◎ | ○ | | |
| EX. 3 | 41.2 | 78 | × | × | ◎ | ◎ |
| | | 61 | △ | × | | |
| | | 40 | ○ | ○ | | |
| | | 22 | ○ | ○ | | |
| EX. 4 | 62.1 | 78 | × | × | ○ | ○ |
| | | 61 | △ | △ | | |
| | | 40 | ◎ | ○ | | |
| | | 22 | ◎ | ○ | | |
| EX. 5 | 75.6 | 78 | × | × | ○ | ○ |
| | | 61 | △ | △ | | |
| | | 40 | ◎ | ○ | | |
| | | 22 | ◎ | ◎ | | |
| EX. 6 | 55.7 | 78 | × | × | ○ | ○ |
| | | 61 | △ | △ | | |
| | | 40 | ◎ | ○ | | |
| | | 22 | ◎ | ○ | | |
| COM. EX. 1 | 32.3 | 78 | × | × | ◎ | ◎ |
| | | 61 | × | × | | |
| | | 40 | △ | △ | | |
| | | 22 | ○ | △ | | |
| COM. EX. 2 | 63.2 | 78 | × | × | × | × |
| | | 61 | △ | △ | | |
| | | 40 | ◎ | ○ | | |
| | | 22 | ◎ | ○ | | |

FIG. 21

| DEVELOPER | NUMBER OF 3μm & BELOW | ANGLE θ2 (°) | OMISSION | REPRODUCIBILITY OF 1,200 dpi DOT | DENSITY CONTROLLABILITY | IRREGURALITY |
|---|---|---|---|---|---|---|
| EX. 1 | 51.4 | 23.9 | × | × | ◎ | ◎ |
| | | 22.3 | △ | △ | | |
| | | 20.2 | ○ | ○ | | |
| | | 18.2 | ◎ | ○ | | |
| EX. 2 | 51.4 | 23.9 | × | × | ◎ | ◎ |
| | | 22.3 | △ | △ | | |
| | | 20.2 | ○ | ○ | | |
| | | 18.2 | ◎ | ○ | | |
| EX. 3 | 41.2 | 23.9 | × | × | ◎ | ◎ |
| | | 22.3 | △ | × | | |
| | | 20.2 | ○ | ○ | | |
| | | 18.2 | ◎ | ○ | | |
| EX. 4 | 62.1 | 23.9 | × | × | ○ | ○ |
| | | 22.3 | △ | △ | | |
| | | 20.2 | ◎ | ○ | | |
| | | 18.2 | ◎ | ○ | | |
| EX. 5 | 75.6 | 23.9 | △ | × | ○ | ○ |
| | | 22.3 | ○ | △ | | |
| | | 20.2 | ◎ | ○ | | |
| | | 18.2 | ◎ | ○ | | |
| EX. 6 | 55.7 | 23.9 | × | × | ○ | ○ |
| | | 22.3 | △ | △ | | |
| | | 20.2 | ◎ | ○ | | |
| | | 18.2 | ◎ | ○ | | |
| COM. EX. 1 | 32.3 | 23.9 | × | × | ◎ | ◎ |
| | | 22.3 | × | × | | |
| | | 20.2 | △ | △ | | |
| | | 18.2 | ○ | △ | | |
| COM. EX. 2 | 53.2 | 23.9 | × | × | × | × |
| | | 22.3 | △ | △ | | |
| | | 20.2 | ◎ | ○ | | |
| | | 18.2 | ◎ | ○ | | |

| | TONER | CIRCULARITY |
|---|---|---|
| EX. 1 | a | 0.943 |
| EX. 2 | b | 0.955 |
| EX. 3 | c | 0.978 |
| EX. 4 | d | 0.968 |
| EX. 5 | e | 0.934 |
| EX. 6 | f | 0.931 |
| EX. 7 | g | 0.928 |
| EX. 8 | h | 0.912 |

FIG. 24

| | TONER | | CARRIER | |
|---|---|---|---|---|
| | KIND | CIRCURARITY | KIND | DEVELOPER |
| EX. 1 | a | 0.943 | A | DEVELOPER 1 |
| EX. 2 | b | 0.955 | A | DEVELOPER 2 |
| EX. 3 | c | 0.978 | A | DEVELOPER 3 |
| EX. 4 | d | 0.968 | A | DEVELOPER 4 |
| EX. 5 | e | 0.934 | A | DEVELOPER 5 |
| EX. 6 | f | 0.931 | A | DEVELOPER 6 |
| EX. 7 | g | 0.928 | A | DEVELOPER 7 |
| EX. 8 | h | 0.912 | A | DEVELOPER 8 |

FIG. 25

| DEVELOPER | CIRCURARITY | ATTEN. RATIO (%) | OMISSION | VERTICAL/ HORIZONTAL | DENSITY CONTROL-LABILITY | IRREG-URARITY |
|---|---|---|---|---|---|---|
| DEVELOPER 1 | 0.943 | 30 | × | × | ○ | ○ |
| | | 40 | △ | △ | | |
| | | 50 | ○ | ○ | | |
| | | 60 | ◎ | ○ | | |
| DEVELOPER 2 | 0.955 | 30 | × | × | ◎ | ◎ |
| | | 40 | △ | × | | |
| | | 50 | ○ | ○ | | |
| | | 60 | ◎ | ○ | | |
| DEVELOPER 3 | 0.978 | 30 | × | × | ◎ | ◎ |
| | | 40 | × | × | | |
| | | 50 | ○ | ○ | | |
| | | 60 | ○ | ○ | | |
| DEVELOPER 4 | 0.968 | 30 | × | × | ◎ | ◎ |
| | | 40 | × | × | | |
| | | 50 | ○ | ○ | | |
| | | 60 | ◎ | ○ | | |
| DEVELOPER 5 | 0.934 | 30 | × | × | ○ | ○ |
| | | 40 | △ | △ | | |
| | | 50 | ◎ | ○ | | |
| | | 60 | ◎ | ◎ | | |
| DEVELOPER 6 | 0.931 | 30 | × | × | ○ | △ |
| | | 40 | △ | △ | | |
| | | 50 | ◎ | ○ | | |
| | | 60 | ◎ | ◎ | | |
| DEVELOPER 7 | 0.928 | 30 | × | △ | △ | △ |
| | | 40 | △ | △ | | |
| | | 50 | ◎ | ○ | | |
| | | 60 | ◎ | ◎ | | |
| DEVELOPER 8 | 0.912 | 30 | × | △ | △ | △ |
| | | 40 | △ | △ | | |
| | | 50 | ◎ | ○ | | |
| | | 60 | ◎ | ◎ | | |

FIG. 26

| DEVELOPER | CIRCURARITY | ANGLE BETWEEN 0 mT POINT (°) | OMISSION | VERTICAL/ HORIZONTAL |
|---|---|---|---|---|
| DEVELOPER 1 | 0.943 | 22 | ◎ | ◎ |
| | | 40 | ○ | ○ |
| | | 61 | × | × |
| | | 78 | × | × |
| DEVELOPER 2 | 0.955 | 22 | ◎ | ◎ |
| | | 40 | ○ | ○ |
| | | 61 | × | × |
| | | 78 | × | × |
| DEVELOPER 3 | 0.978 | 22 | ○ | ○ |
| | | 40 | ○ | ○ |
| | | 61 | × | × |
| | | 78 | × | × |
| DEVELOPER 4 | 0.968 | 22 | ○ | ○ |
| | | 40 | ○ | ○ |
| | | 61 | × | × |
| | | 78 | × | × |
| DEVELOPER 5 | 0.934 | 22 | ◎ | ◎ |
| | | 40 | ◎ | ◎ |
| | | 61 | △ | △ |
| | | 78 | × | × |
| DEVELOPER 6 | 0.931 | 22 | ◎ | ◎ |
| | | 40 | ◎ | ◎ |
| | | 61 | △ | △ |
| | | 78 | × | × |
| DEVELOPER 7 | 0.928 | 22 | ◎ | ◎ |
| | | 40 | ◎ | ◎ |
| | | 61 | △ | △ |
| | | 78 | × | × |
| DEVELOPER 8 | 0.912 | 22 | ◎ | ◎ |
| | | 40 | ◎ | ◎ |
| | | 61 | △ | △ |
| | | 78 | × | × |

FIG. 27

| DEVELOPER | CIRCULARITY | ANGLE θ2 (°) | OMISSION | VERTICAL/HORIZONTAL |
|---|---|---|---|---|
| DEVELOPER 1 | 0.943 | 18.2 | ◎ | ◎ |
| | | 20.2 | ○ | ○ |
| | | 22.3 | △ | △ |
| | | 23.9 | × | × |
| DEVELOPER 2 | 0.955 | 18.2 | ◎ | ◎ |
| | | 20.2 | ○ | ○ |
| | | 22.3 | △ | △ |
| | | 23.9 | × | × |
| DEVELOPER 3 | 0.978 | 18.2 | ○ | ○ |
| | | 20.2 | ○ | ○ |
| | | 22.3 | △ | △ |
| | | 23.9 | × | × |
| DEVELOPER 4 | 0.968 | 18.2 | ○ | ○ |
| | | 20.2 | ○ | ○ |
| | | 22.3 | △ | △ |
| | | 23.9 | × | × |
| DEVELOPER 5 | 0.934 | 18.2 | ◎ | ◎ |
| | | 20.2 | ◎ | ◎ |
| | | 22.3 | △ | △ |
| | | 23.9 | × | × |
| DEVELOPER 6 | 0.931 | 18.2 | ◎ | ◎ |
| | | 20.2 | ◎ | ◎ |
| | | 22.3 | △ | △ |
| | | 23.9 | × | × |
| DEVELOPER 7 | 0.928 | 18.2 | ◎ | ◎ |
| | | 20.2 | ◎ | ◎ |
| | | 22.3 | △ | △ |
| | | 23.9 | × | × |
| DEVELOPER 8 | 0.912 | 18.2 | ◎ | ◎ |
| | | 20.2 | ◎ | ◎ |
| | | 22.3 | △ | △ |
| | | 23.9 | × | × |

DEVELOPING DEVICE USING A TWO-INGREDIENT TYPE DEVELOPER AND IMAGE FORMING APPARATUS INCLUDING THE SAME

BACKGROUND OF THE INVENTION

1. Field of the Invention

The present invention relates to a developing device using a two-ingredient type developer consisting of toner grains and carrier grains and an image forming apparatus and an image forming process unit including the same each.

2. Description of the Background Art

It is a common practice with an electrophotographic image forming apparatus to form a latent image on an image carrier, i.e., a photoconductive drum or belt in accordance with image data and develop the latent image with a developing device for thereby producing a corresponding toner image. The image forming apparatus uses either one of a one-ingredient type developer, i.e., toner and a two-ingredient type developer made up of toner and magnetic carrier grains. A developing device using the one-ingredient type developer is simple in construction and can be easily reduced in size. On the other hand, a developing device using the two-ingredient type developer is stable and long life and feasible for high-speed applications.

In the two-ingredient type developer, fine toner grains deposit on relatively large, magnetic carrier grains due to an electric force generated by friction acting between such two kinds of grains. When this type of developer approaches a latent image formed on the image carrier, an electric field formed between the image carrier and the latent image causes attraction tending to pull the toner grains toward the latent image to act. When the attraction overcomes adhesion acting between the toner grains and the carrier grains, the toner grains are deposited on the latent image for thereby developing it.

In the developing system using the two-ingredient type developer, the developer is repeatedly used while being replenished with fresh toner for making up for consumption. It is therefore necessary to maintain the toner content of the developer, i.e., the mixture ratio of the carrier grains and toner grains constant enough to insure stable image quality. To meet this requirement, a conventional developing device of the kind using the two-ingredient type developer needs a toner replenishing mechanism and a toner content sensor, resulting in a bulky construction and a sophisticated operation mechanism.

On the other hand, in the developing system using the one-ingredient type developer, toner grains deposit on the developer carrier due to an electric force derived from friction acting between the toner grains and the developer carrier or the magnetic force of a magnet disposed in the developer carrier. The toner grains deposit on the latent image formed on the image carrier because of the same mechanism as described in relation to the toner grains of the two-ingredient type developer. A developing device using the one-ingredient type developer can be reduced in size because it is not necessary to control the toner content of a developer. However, the number of toner grains available in a developing zone is too small to implement sufficient transfer of the toner grains to the image carrier. Therefore, the one-ingredient type developer is not feasible for a high-speed copier.

In light of the above, Japanese Patent Laid-Open Publication No. 9-22178, for example, proposes a developing device with automatic toner-content control capability that obviates the need for a toner replenishing device and a toner content sensor. Specifically, this developing device uses a developer carrier accommodating magnetic field forming means therein. In the developing device, a condition in which a two-ingredient type developer being conveyed by the developer carrier and fresh toner to be replenished contact each other is varied in accordance with the variation of the toner content of the developer. Consequently, the developer on the developer carrier is caused to automatically take in the fresh toner for maintaining a constant toner content. The developing device is therefore free from the drawbacks of the conventional developing device using a two-ingredient type developer, i.e., it is small size and simple in operation mechanism. It follows that the tow-ingredient type developer superior to the one-ingredient type developer in stability, service life and high-speed operation is desirable for such a developing device.

In the development system using a two-ingredient type developer, the closer the image carrier and developer carrier in the developing zone, the higher the resulting image density and the less the edge effect, as well known in the art. However, when the image carrier and developer carrier are positioned close to each other, it is likely that the trailing edge of a black solid image or that of a halftone solid image is lost. Further, it is likely that horizontal thin lines parallel to the axis of a sleeve or developer carrier become thinner than vertical fine lines or that solitary dots cannot be stably reproduced.

When the toner grains of the two-ingredient type developer are implemented as nonmagnetic grains, the toner grains of the developer deposited on the sleeve are scattered around due to a centrifugal force ascribable to the rotation of the sleeve. Such toner scattering becomes more conspicuous as the rotation speed of the sleeve is increased, so that nonmagnetic toner grains obstruct high-seed image formation.

To obviate toner scattering, the toner grains of the two-ingredient type developer may be implemented as magnetic toner grains. However, in the developing zone, magnetic toner grains are subjected to the magnetic force of the magnetic carrier grains directed away a photoconductive drum or image carrier. This magnetic force of the carrier grains, coupled with electrostatic attraction, makes it easier for the toner to leave the photoconductive drum, resulting in the omission of the trailing edge of an image.

Assume that the toner grains of the two-ingredient type developer are implemented as magnetic, spherical toner grains. Then, the toner grains have small surface energy each and easily move on the surfaces of the carrier grains. Therefore, the toner grains deposit on the surfaces of the carriers in an annular configuration at the position where the photoconductive drum and the tip of a magnet brush contact. Consequently, the bared carrier grain on the tip of the magnet brush faces the drum, aggravating the omission ascribable to toner drift, which will be described later specifically. There also occur the thinning of horizontal lines and unstable solitary dots due to the same mechanism, lowering image quality.

Today, toner produced by polymerization is attracting increasing attention and meets the demand for a small grain size capable of further enhancing image quality. Polymerization makes the individual toner grain more spherical and the grain size distribution narrower than conventional pulverization and therefore realizes high yield and cost reduction. In addition, polymerization consumes a minimum of energy on a production line.

To solve the various image defects stated above, Japanese Patent Laid-open Publication No. 2000-305360, for example, discloses a developing device provided with a particular flux density distribution in the normal to the surface of a sleeve. With the particular flux density distribution, it is possible to reduce the width of a developing zone in the direction of rotation of the sleeve, i.e., a nip width or to increase the density of a magnet brush in the developing zone. This prior art developing device will be described later more specifically.

There is an increasing demand for copied images or printed images with higher definition and higher resolution. The developing device taught in the above Laid-Open Publication No. 2000-305360 contributes to the enhancement of definition and resolution in that it improves the stability of solitary dots. However, even such a developing device is not satisfactory as to the reproducibility of a single dot whose resolution is as high as, e.g., 1,200 dpi (dots per inch) for the following reasons. First, because the width of the developing zone is reduced, the number of toner grains available in the developing zone is reduced, i.e., a sufficient amount of toner grains cannot be fed to the photoconductive drum. Second, when use is made of the two-ingredient type developer containing magnetic grains, the magnetic force acting on the toner grains interferes with the electrostatic force of a magnetic field tending to transfer the toner grains from the sleeve to the drum.

On the other hand, Japanese Patent Publication Nos. 6-82227 and 7-60273 each propose a particular developer having a small mean grain size and provided with a specific content of toner grains having grain sizes of 5 $\mu$m and below and a specific grain size distribution. Such a developer may enhance the definition and resolution of an image when applied to the developing system using a two-ingredient type developer. However, it was, in practice, difficult to reproduce a single dot with the ultrahigh resolution of 1,200 dpi by applying the above developer to the developing device disclosed in Laid-Open Publication No. 2000-305360 mentioned earlier.

Technologies relating to the present invention are also disclosed in, e.g., Japanese Patent Laid-Open Publication Nos. 6-332237, 8-114986, 9-22178, 2000-39740, 321867, 2001-27849 and 2001-296743.

SUMMARY OF THE INVENTION

It is an object of the present invention to provide a developing device capable of faithfully reproducing even an image with ultrahigh resolution despite the narrow developing zone and the use of magnetic toner grains, and an image forming apparatus and an image forming process unit using the same each.

It is another object of the present invention to provide a developing device capable of reducing toner scattering and obviating various image defects despite the high linear velocity of a developer carrier even when use is made of spherical, magnetic toner grains, and an image forming apparatus and an image forming processing unit using the same each.

A developing device of the present invention uses a developer containing magnetic toner grains and includes a main pole for development disposed in a sleeve. Flux density generated by the magnetic pole in a direction normal to the surface of the sleeve outside of the surface has an attenuation ratio of 50% or above. The toner grains have a weight mean grain size of 6.0 $\mu$m to 8.0 $\mu$m while the toner grains having grain sizes of 5 $\mu$m and below occupy 40 number % to 80 number % of the entire developer. The toner grains have magnetization strength of 10 emu/g to 25 emu/g in a magnetic field of 5 kOe or magnetization strength of 7 emu/g to 20 emu/g in a magnetic field of 1 kOe. The toner grains reduce toner scattering and image defects despite that they are magnetic, thereby implementing ultrahigh resolution, image reproducibility.

BRIEF DESCRIPTION OF THE DRAWINGS

The above and other objects, features and advantages of the present invention will become more apparent from the following detailed description taken with the accompanying drawings in which:

FIG. 16 is a table listing exemplary procedures particular to a first embodiment and comparative procedures used to estimate images;

FIG. 18 is a table listing the conditions of Experiment 1 conducted to estimate images derived from the exemplary procedures and comparative procedures of FIG. 16;

FIG. 19 is a table listing the results of Experiment 1;

FIG. 20 is a table listing the results of Experiment 2;

FIG. 21 is a table listing the results of Experiment 3;

FIG. 24 is a table listing developers 1 through 8 used for Experiment 1 of the second embodiment;

FIG. 25 is a table listing the results of Experiment 1;

FIG. 26 is a table listing the results of Experiment 2; and

FIG. 27 is a table listing the results of Experiment 3.

DESCRIPTION OF THE PREFERRED EMBODIMENTS

Figure 1:
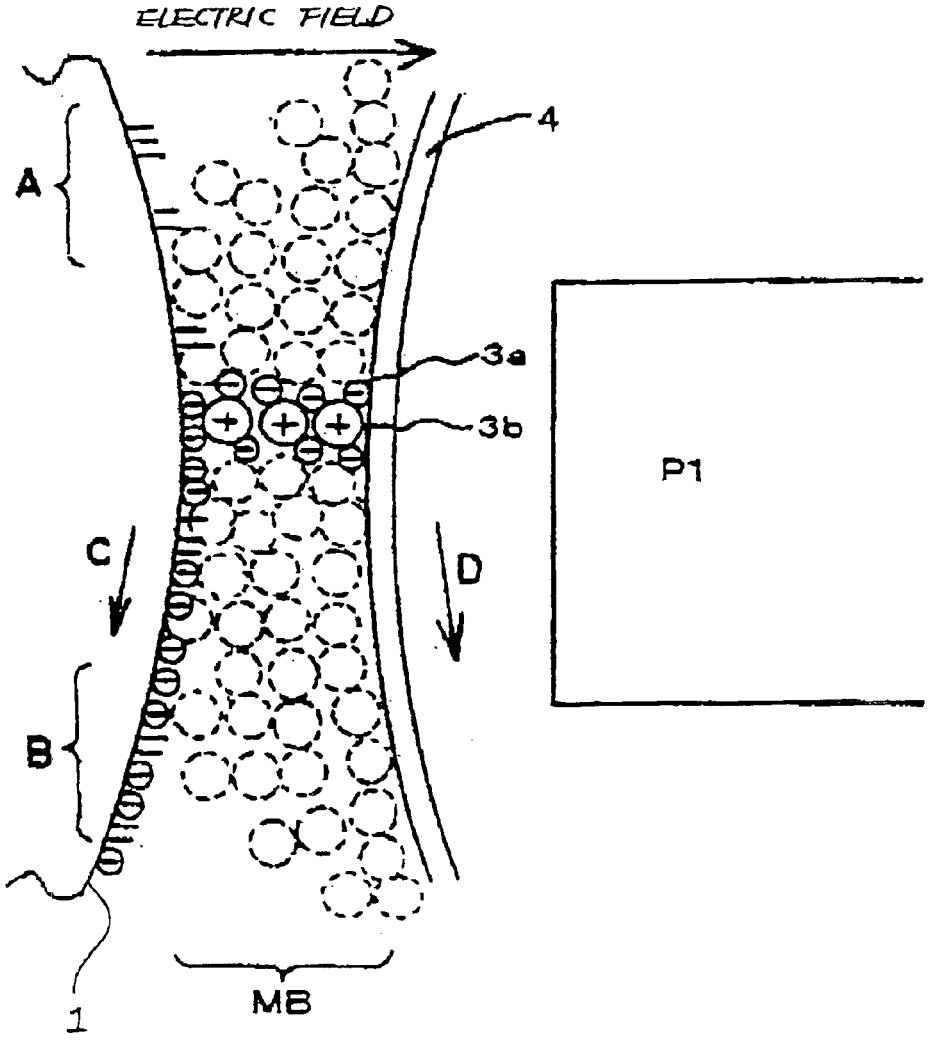
FIG. 1 PRIOR ART
FIG. 1 is an enlarged view showing a developing zone included in a developing device of the type effecting negative-to-positive development with a two-ingredient type developer.

To better understand the present invention, why the omission of the trailing edge of an image occurs in the conventional developing device will be described more specifically with reference to the accompanying drawings. FIG. 1 shows a developing zone included in a developing device of the type effecting negative-to-positive development by use of a two-ingredient type developer. In FIG. 1, small circles and large circles are representative of toner grains 3*a* and carrier grains 3*b*, respectively. Further, in FIG. 1, while a plurality of brush chains MB contact a photoconductive drum 1 in the developing zone, only one brush chain MB is indicated by a solid line while the other brush chains are indicated by phantom lines with toner grains thereof being not shown. Non-image portions where a latent image is absent are included in an image region A formed on the drum 1, but not developed, and an image region B formed on the drum 1 and developed are assumed to be charged to negative polarity.

As shown in FIG. 1, the developer deposited on a sleeve or hollow cylindrical developer carrier 4 is conveyed toward the developing zone where the sleeve 4 and drum 1 face each other in accordance with the rotation of the sleeve 4, as indicated by an arrow D. In the developer approached the developing zone, the carrier grains 3*b* rise in the form of a magnet brush MB due to the magnetic force of a main pole P1, which is positioned inside the sleeve 4. At this instant, the drum 1 is rotating in a direction C while carrying a latent image thereon.

In the developing zone, the magnet brush MB rubs the latent image on the drum 1 due to a difference in linear velocity between the drum 1 and the sleeve 4 (the former is lower than the latter). As a result, the toner grains 3*a* deposit on the image portion of the drum 1 where the latent image is present under the action of an electric field for development formed in the developing zone, producing a toner image in the image region B at the downstream side in the direction of rotation of the drum 1. Generally, the linear velocity of the sleeve is higher than the linear velocity of the drum 1, so that preselected image density is achievable.

Figure 2A:
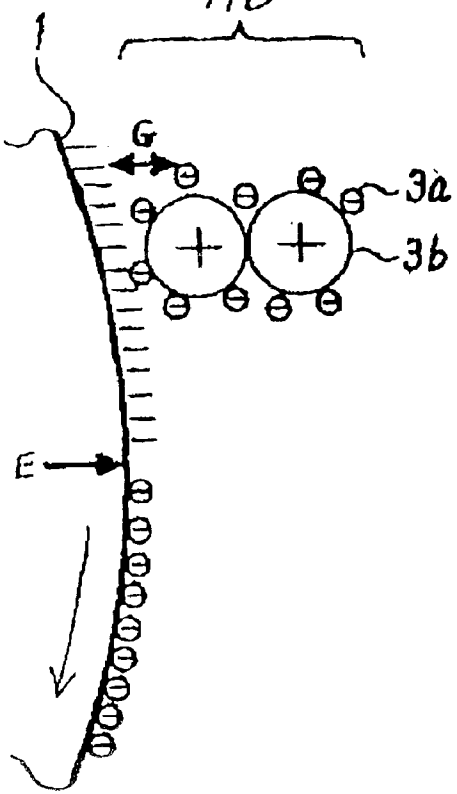
FIG. 2A PRIOR ART
FIGS. 2A through 2C are views demonstrating why the trailing edge of an image is lost in the developing device of FIG. 1.
Figure 2B:
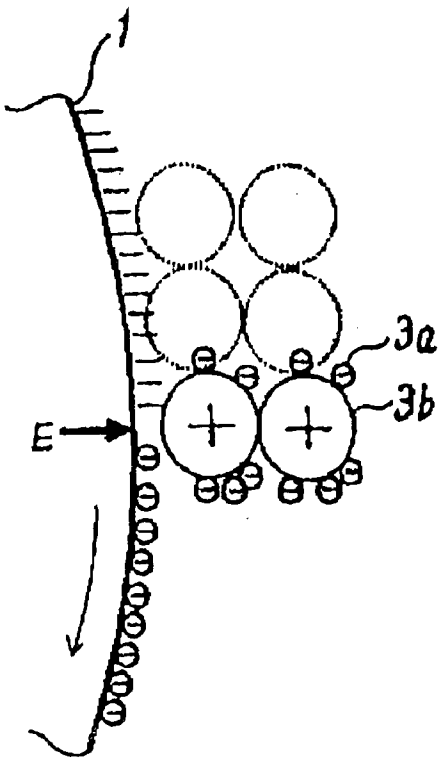
FIG. 2B PRIOR ART
Figure 2C:
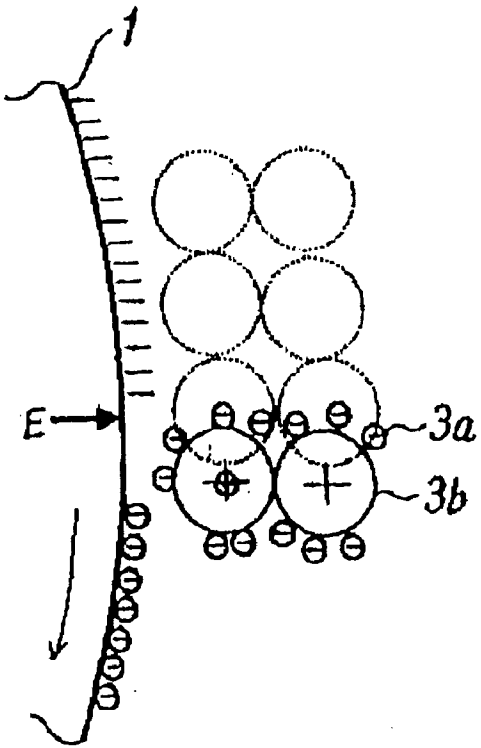
FIG. 2C PRIOR ART

FIGS. 2A through 2C show the portion the drum 1 and sleeve 4 face each other in an enlarged scale and demonstrate a mechanism that brings about the omission of the trailing edge of an image. More specifically, FIGS. 2A through 2C show how the tip of the magnet brush MB approaches the drum 1 with the elapse of time. In FIGS. 2A through 2C, the magnet brush MB is shown as developing a boundary between a non-image portion and a black solid image, i.e., in a condition that is apt to bring about the omission of the trailing edge of an image. A toner image just formed is positioned on the drum 1 at the downstream side in the direction of rotation of the drum 1. Although the drum 1 is, in practice, rotating clockwise, the brush chain MB passes the drum 1 because the sleeve 4 moves at higher linear velocity than the drum 1. This is why FIGS. 2A through 2C show the drum 1 as if it were stationary for simplicity.

As shown in FIG. 2A, the brush chain MS approaches the drum 1 while facing the non-image portion up to the trailing edge E of the image portion to be developed. At this instant, a repulsive force G acting between the negative charges causes the toner grains 3*a* to move away from the drum 1 toward the sleeve surface little by little (so-called toner drift). As a result, as shown in FIG. 2B, about the time when the brush chain MB reaches the trailing edge E of the image portion, the carrier grains 3*b* forming the brush chain MB and adjoining the drum 1 are exposed to the outside. That is, the toner grains 3*a* are absent on the surfaces of the carrier grains 3*b* that face the trailing edge E of the image portion, and therefore do not move toward the drum 1. As shown in FIG. 2C, when the brush chain MB arrives at the trailing edge of the image portion, and if adhesion acting between the toner grains 3*a* and the drum 1 is weak, then the toner grains 3*a* deposited on the drum 1 are likely to return to the carrier grains 3*b* due to an electrostatic force. Consequently, it is likely that the trailing edge of the image portion close to the non-image portion is not developed and is therefore lost.

Figure 3A:
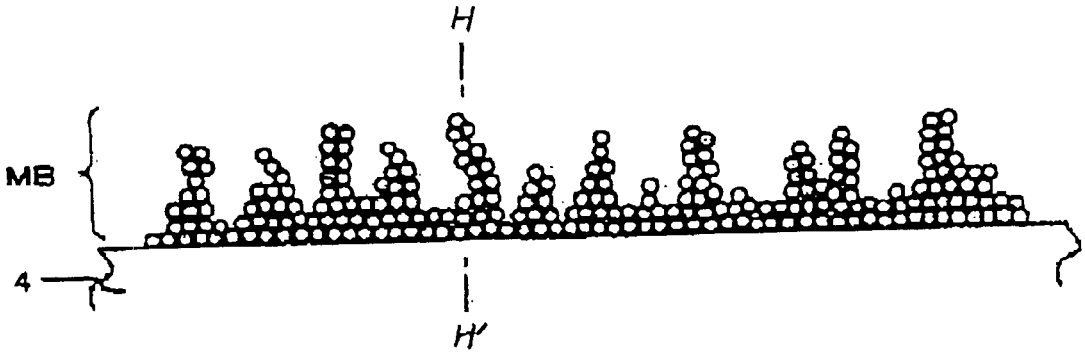
FIG. 3A PRIOR ART
FIG. 3A shows a magnet brush distribution set up in the developing zone of a conventional developing device in the axial direction of a sleeve.
Figure 3B:
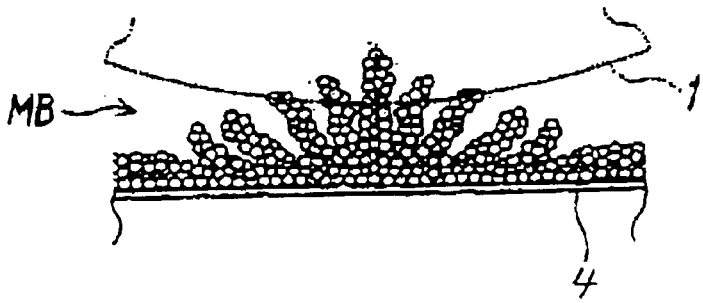
FIG. 3B PRIOR ART
FIG. 3B shows the magnet brush as seen in the direction in which the surface of the sleeve moves.

While the above description has concentrated on a section perpendicular to the axis of the sleeve 4, the brush chains constituting the magnet brush MB are different in length, or height, in the lengthwise or axial direction of the sleeve, as will be described hereinafter. FIG. 3A shows the magnet brush MB extending in the axial direction of the sleeve 4. FIG. 3B is a section along line H–H' of FIG. 3A. FIG. 5B additionally shows a relation between the magnet brush MB and the drum 1 in order to show a relation between FIG. 5B and the other figures.

Figure 4A:
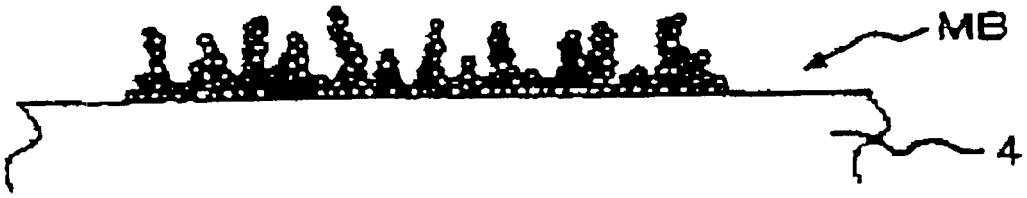
FIG. 4A PRIOR ART
FIG. 4A shows a magnet brush distribution set up in the developing zone of a conventional developing device in the axial direction of a sleeve.
Figure 4B:
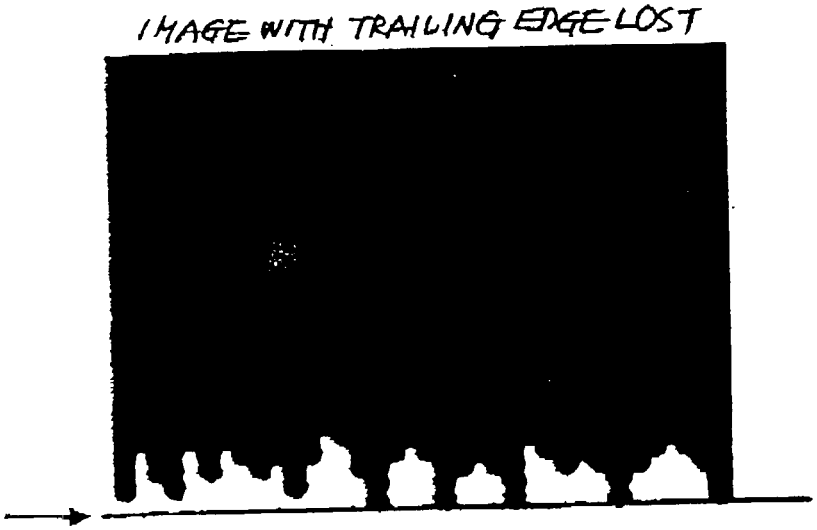
FIG. 4B PRIOR ART
FIG. 4B shows a specific solid image developed by the developing device of FIG. 4A.

As shown in FIGS. 3A and 4A, the brush chains constituting the magnet brush MB are noticeably different in height from each other in the axial direction of the sleeve 4 and therefore contact the drum 1 at different positions. Consequently, the degree of toner drift and therefore that of the omission of the trailing edge is irregular in the axial direction of the sleeve 4, resulting in jagged local omission shown in FIG. 4B.

Japanese Patent Laid-Open Publication No. 2000-305360 mentioned earlier proposes a measure against the omission of the kind described as well as against the thinning of horizontal lines and unstable solitary dots. The measure consists in defining a particular flux density distribution in the direction normal to the surface of the sleeve 4 that can reduce the width of the developing zone in the direction of movement of the sleeve 4 and can increase the density of the brush chains MB in the developing zone, as will be described specifically later.

Reducing the width of the developing zone is successful to improve the omission of the trailing edge of an image and other defects, as has already been determined by experiments. This is presumably because a narrow developing zone reduces the duration of contact of the magnet brush with the non-image portion of the drum 1 and therefore tone drift. This will be described in detail with reference to FIGS. 5A through 5C corresponding to FIGS. 2A through 2C, respectively.

Figure 5A:
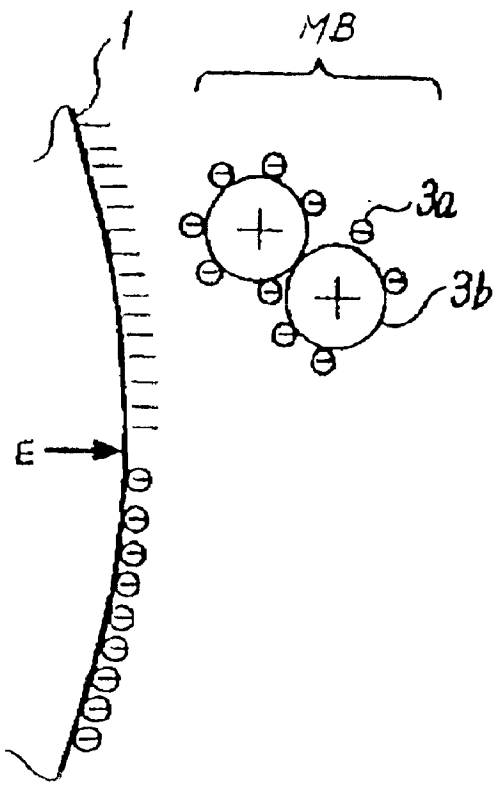
FIG. 5A PRIOR ART
FIGS. 5A through 5C are views for describing why the omission of the trailing edge of an image is reduced when the attenuation ratio of a flux density distribution normal to a sleeve is 50% or below.
Figure 5B:
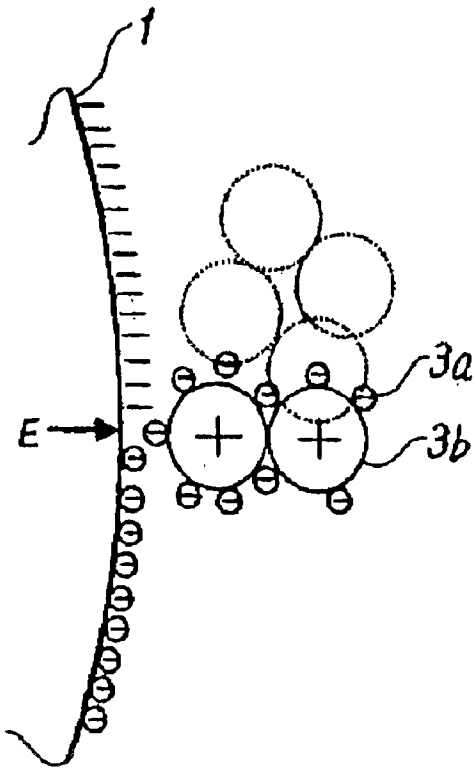
FIG. 5B PRIOR ART
Figure 5C:
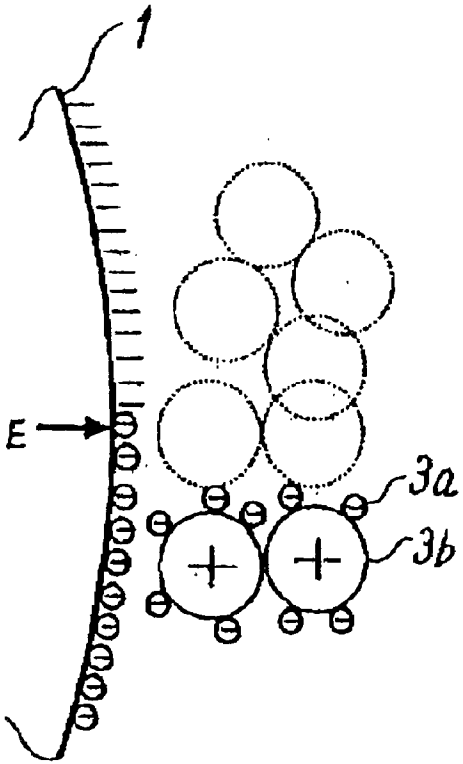
FIG. 5C PRIOR ART

As shown in FIGS. 5A through 5C, when the developing zone is reduced in width, the period of time over which the magnet brush MB rubs the surface of the drum 1 reduced, compared to the configuration shown in FIGS. 2A through 2C. Therefore, as shown in FIG. 5A, when the magnet brush MB moves while facing the non-image portion of the drum 1, the repulsive force, acting between the negative charge on the drum surface and the negative charge on the toner grains 3*a* is weak. Consequently, as shown in FIG. 5B, when the magnet brush MB reaches the trailing edge E of the image portion, the carrier grains 3*b* of positive polarity included in the magnet brush MB are not exposed to the outside. It follows that the carrier grains 3*b* are still covered with the toner grains 3*a* even at the trailing edge of the image portion, as shown in FIG. 5C, thereby reducing toner drift.

Figure 6:
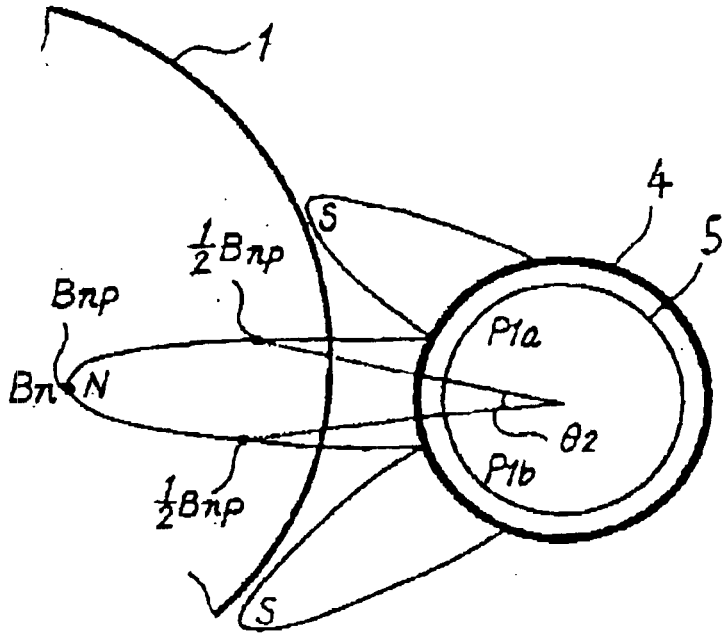
FIG. 6 PRIOR ART
FIG. 6 is a view for describing a half-value angle.

The width of the developing zone can be effectively reduced if the half-value angle of the main pole P1, FIG. 1, is reduced. As shown in FIG. 6, the half-value angle refers to an angle θ2, as seen from the axis of the sleeve 4, between two points of the flux distribution generated by the main pole P1 where the flux density is one-half of the maximum flux density Bn in the direction normal to the surface of the sleeve 4. For example, if the main pole P1 is an N pole and has the maximum flux density Bn of 120 mT, then the half-value ½ Bn is 60 mT. It was experimentally determined that a half-value angle of 22° or less reduced the problems stated above.

Figure 7:
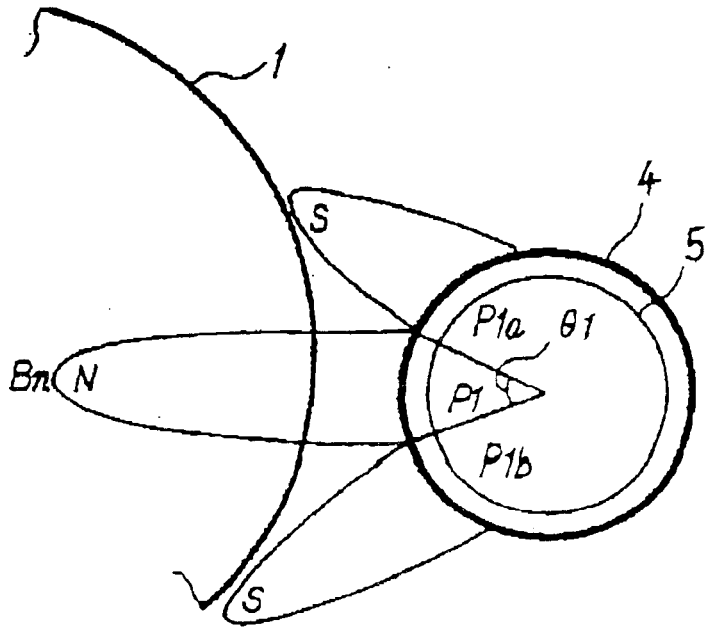
FIG. 7 PRIOR ART
FIG. 7 is a view for describing an angle between pole transition points where flux density is 0 mT.

FIG. 7 shows another specific implementation for reducing the width of the developing zone. As shown, an angle θ1 between opposite pole-transition points where the flux density in the direction normal to the surface of the sleeve 4 is 0 mT is reduced. It was also experimentally determined that an angle θ1 of 40° or less reduced the problems stated above.

However, it is sometimes difficult to fully obviate the omission and other image defects simply by reducing the half-value angle θ2 or the angle θ1 between the pole-transition points stated above. This is presumably because the width of the developing zone cannot be easily reduced over the entire axial range of the sleeve 4, as shown in FIG. 3A. More specifically, the length or height of the magnet brush MB is irregular in the axial direction of the sleeve 4. Therefore, if any part of the brush chain MB is higher than the other part, the higher part prevents the width of the developing zone from being reduced and brings about toner drift.

To further reduce the omission and other defects, Japanese Patent Laid-Open Publication No. 2000-305360 mentioned earlier discloses a developing device configured to reduce the length of the magnet brush in the developing zone and free the height of the magnet brush MB from irregularity in the axial direction of the sleeve 4 by making the magnet brush MB dense. To reduce the length of the magnet brush MB and make the magnet brush MB dense, there may be increased, in the flux distribution generated by the main pole P1 in the developing zone, the attenuation ratio of the flux density in the direction normal to the surface of the sleeve 4 (normal flux density hereinafter). As for attenuation ratio, assume the normal flux density has a peak value X on the surface of the sleeve 4 and has a peak value Y at a position spaced from the surface of the sleeve 4 by 1 mm. Then, the attenuation ratio (%) is expressed as:

$$\text{attenuation ratio}=\{(X-Y)/X\}\times 100 \qquad \text{Eq. (1)}$$

For example, if the normal flux density is 100 mT on the surface of the sleeve 4 and 70 mT at the position spaced from the sleeve surface by 1 mm, then the attenuation ratio is 20%. To measure the normal flux density, use may be made of a gauss meter HGM-8300 or an axial probe Type A1 available from ADS. Experiments showed that when the attenuation ratio was 40% or above, preferably 50% or above, there could be formed a magnet brush MB short enough to sufficiently reduce the omission and other defects and dense enough to be sufficiently uniform in the axial direction of the sleeve 4.

Why the high attenuation ratio makes the magnet brush MB short and dense will be described specifically hereinafter. When the attenuation ratio is high, the magnetic force of the magnet brush MB sharply decreases with an increase in the distance from the surface of the sleeve 4. As a result, the magnetic force on the tip of the magnet brush MB becomes too weak to maintain the magnet brush MB, causing the carrier grains 3*b* on the tip of the magnet brush MB to be attracted by the sleeve 4. The attenuation ration can be increased if the material of a magnet forming the main pole P1 is adequately selected or if the turn-round of the magnetic lines of force issuing from the main pole P1 are intensified. To intensify the turn-round of the magnetic lines of force, auxiliary magnetic poles opposite in polarity to the main pole P1 may be positioned upstream and downstream of the main pole P1 in the direction of movement of the sleeve 4.

Figure 8A:
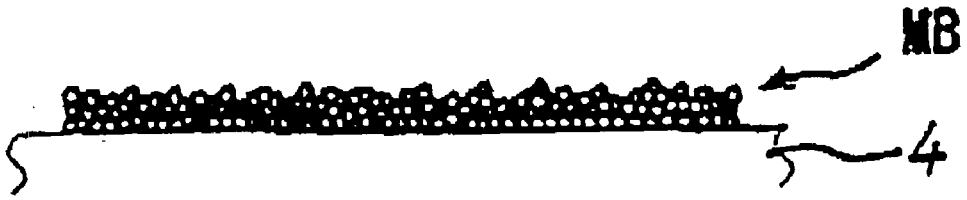
FIG. 8A PRIOR ART
FIG. 8A shows a magnet brush distribution set up in the developing zone in the axial direction of the sleeve when the attenuation ratio is 50% or below.
Figure 8B:
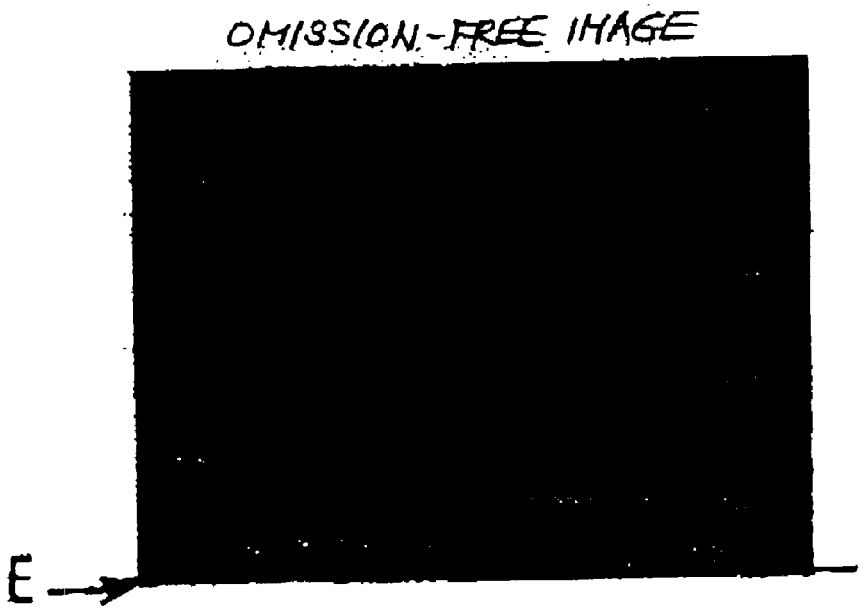
FIG. 8B PRIOR ART
FIG. 8B shows a specific solid image output in the condition shown in FIG. 8A.

As shown in FIG. 8A, when the attenuation ratio is high, the magnet brush MB is sufficiently short and uniform when reaching the developing zone. Such a short magnet brush MB reduces the width of the developing zone and enters, the developing zone with a uniform height in the axial direction of the sleeve 4, thereby sufficiently reducing toner drift at any position in the above direction. FIG. 8B shows the resulting image free from the omission of a trailing edge.

Figure 9:
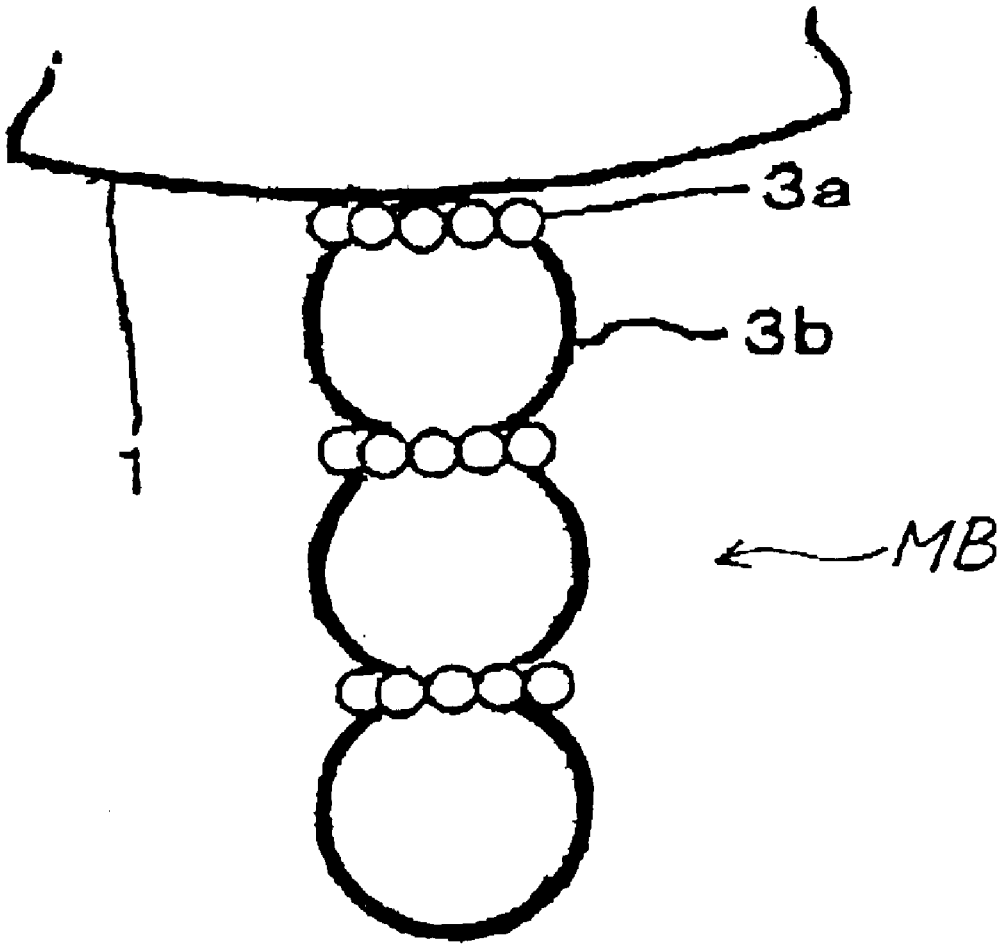
FIG. 9 PRIOR ART
FIG. 9 shows the distribution of magnetic toner grains at the tip of a magnet brush.

Assume that the toner grains of the two-ingredient type developer are implemented as magnetic, spherical toner grains. Then, the toner grains are distributed as shown in FIG. 9 specifically. The magnetic, spherical toner grains 3*a* have small surface energy each and easily move on the surfaces of the carrier grains 3*b*. Therefore, as shown in FIG. 9, the toner grains 3*a* deposit on the surfaces of the carriers 3*b* in an annular configuration at the position where the drum 1 and the tip of the magnet brush MB contact each other. Consequently, the bared carrier grain 3*b* on the tip of the magnet brush MB faces the drum 1, aggravating the omission ascribable to toner drift. There also occurs with the thinning of horizontal lines and unstable solitary dots because of the same mechanism, lowering image quality.

Figure 10:
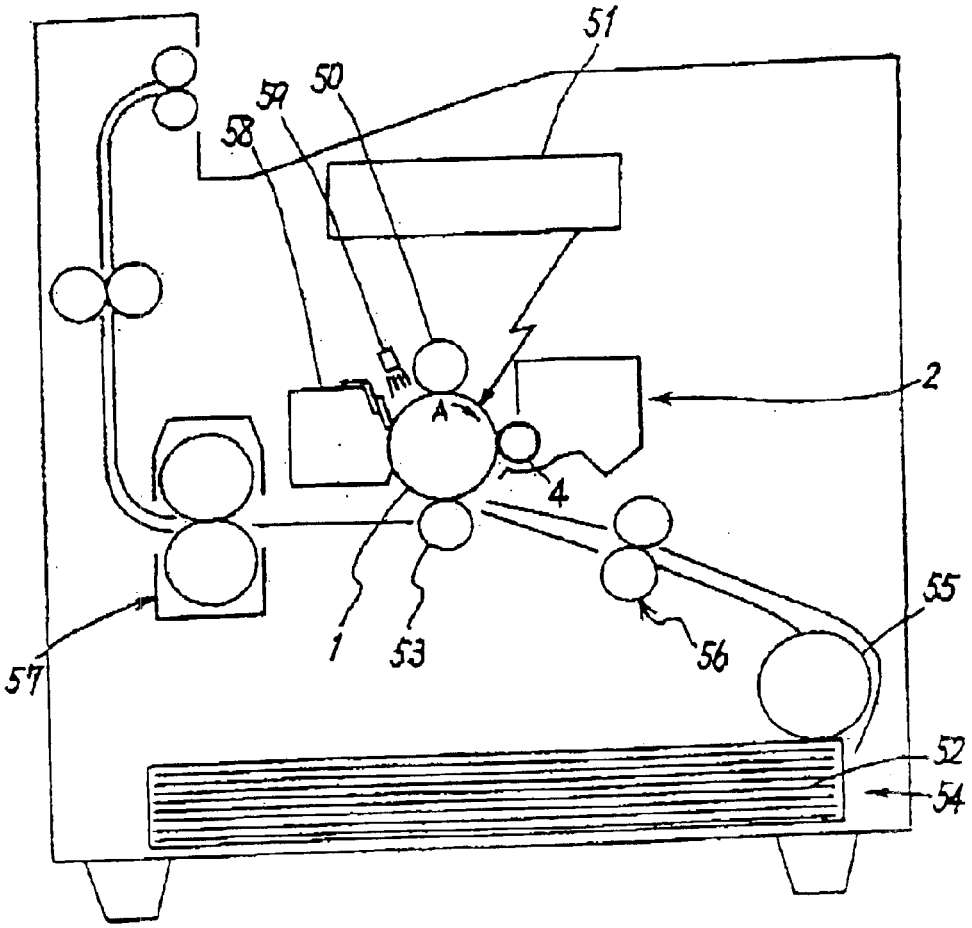
FIG. 10 shows an image forming apparatus to which illustrative embodiments of the present invention are applicable.

Referring to FIG. 10, a developing device embodying the present invention is shown and applied to a laser printer by way of example. As shown, the printer includes a photoconductive drum or image carrier 1. While the drum 1 is rotated in a direction A, a charge roller or charging means 50 held in contact with the drum 1 uniformly charges the surface of the drum 1. An optical writing unit or latent image forming means 51 scans the charged surface of the drum 1 with a light beam in accordance with image data, thereby forming a latent image on the surface of the drum 1. Of course, the charge roller 50 and optical writing unit 51 are a specific form of charging means and a specific form of latent image forming means, respectively.

A developing device 2, which will be described in detail later, develops the latent image formed on the drum 1 to thereby produce a corresponding toner image. An image transferring unit or image transferring means includes an image transfer roller 53 and transfers the toner image from the drum 1 to a sheet or recording medium 52, which is fed from a sheet cassette 54 via a registration roller pair 56. A fixing unit or fixing means 57 fixes the toner image on the sheet 52. Subsequently, the sheet 52 with the fixed toner image is driven out of the printer. A cleaning unit or cleaning means 58 removes the toner grains left on the drum 1 after the image transfer, and then a quenching lamp or discharging means 59 discharges the surface of the drum 1.

The developing device 2 will be described specifically with reference to FIG. 11. As shown, the developing device 2 is positioned to face the surface of the drum 1 and effects development by use of a mixture of magnetic toner grains 3*a* and magnetic carrier grains 3*b*. The developing device 2 includes a sleeve or nonmagnetic developer carrier 4 for depositing the developer thereon. The sleeve 4 faces the drum 1 through an opening formed in part of a casing 2*a* and is driven by drive means, not shown, in a direction indicated by an arrow B in FIG. 11. In this condition, the developer deposited on the sleeve 4 is moved downward, as viewed in FIG. 11, in a developing zone D where the sleeve 4 and drum 1 faces each other.

While the developer 3 on the sleeve 4 is conveyed toward the developing zone D, a doctor or metering member 6 regulates the amount of the developer 3. A developer case 7 forms a developer chamber S between the surface of the sleeve 4 and the doctor 6 at the upstream side of the doctor 6 in the direction of the developer conveyance. The developer 3 is stored in the developer chamber S. A toner hopper 8 stores fresh, magnetic toner to be replenished to the developer 3. More specifically, the toner hopper 8 is formed with an opening 8*a* adjoining the upstream portion of the toner chamber S in the above direction and facing the surface of the sleeve 4, so that the fresh, magnetic toner 3*a* can be replenished to the developer 3. An agitator or toner agitating means 9 is disposed in the toner hopper 8 and rotatable in a direction C. The agitator 9 in rotation conveys the magnetic toner 3*a* toward the opening 8*a* while agitating it.

The edge of the developer case 7 adjoining the sleeve 4 forms a predoctor or second metering member 7*a* that regulates the amount of the developer replenished with the fresh toner 3*a* and moving toward the developer chamber S.

A magnet roller or magnetic field forming means 5 is disposed in the sleeve 4 and implemented by a group of stationary magnets. The magnets are so arranged on the surface of the magnet roller 5 as to form magnetic poles each extending in the axial direction and radially outward direction of the magnet roller 5. More specifically, a main pole P1 (N pole) is positioned in the developing zone D and causes the developer to rise in the form of brush chains or magnet brush. Auxiliary poles P1*a* (S pole) and P1*b* (S pole) adjoin the main pole P1 at the upstream side and downstream side, respectively, in the direction of rotation of the sleeve 4. The auxiliary poles P1*a* and P1*b* opposite in polarity to the main pole P1 serve to reduce the previously stated half-value angle of the flux density distribution formed by the main pole P1 in the direction normal to the surface of the sleeve 4.

A pole P4 (N pole) is positioned between the predoctor 7*a* and the developing zone D, exerting a magnetic force on the developer chamber S. Further, poles P3 (N pole) and P3 (S pole) convey the developer deposited on the sleeve 4.

Figure 11:
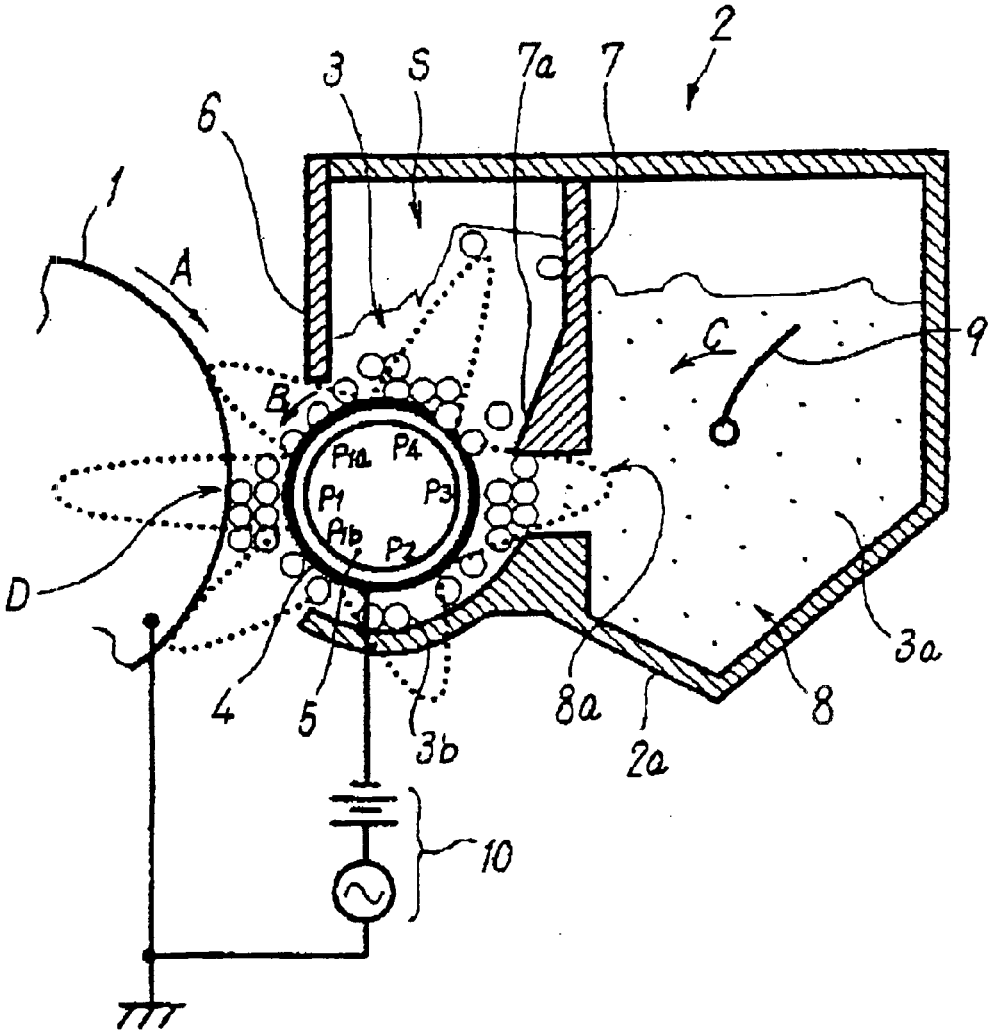
FIG. 11 shows a developing device included in the apparatus of FIG. 10.

In FIG. 11, dotted curves around the sleeve 4 are representative of flux densities formed by the various poles P1 through P4 at the center portion of the sleeve in the direction normal to the surface of the sleeve 4.

While the magnet roller 5 is shown as having six poles in total, two or four additional poles, for example, may be arranged between the auxiliary poles P1*b* and P1*a*, if desired.

The main pole P1 is implemented by a magnet having a small sectional area in a cross-section perpendicular to the axis of rotation of the magnet roller 5. Generally, the magnetic force on the sleeve surface decreases with a decrease in the sectional area of the above magnet. Therefore, if the magnetic force on the surface of the sleeve surface is excessively small, then the carrier grains 3*b* are apt to deposit on the drum 1. In light of this, in the illustrative embodiment, the magnet forming the main pole P1 is formed of an alloy of rare earth metal. A magnet formed of iron-neodymium-boron alloy, which is a typical rare earth metal alloy, has the maximum energy product of 358 kJ/m$^3$ while a magnet formed of iron-neodymium-boron alloy bond has the maximum energy product of 80 kJ/m$^3$. Such a magnet therefore exerts a greater magnetic force than, e.g., a ferrite magnet whose maximum energy product is 36 kJ/m$^3$ or so or a ferrite bond magnet whose maximum energy product is 20 kJ/m$^3$. This is why even a magnet having a small sectional area can exert a required magnetic force on the sleeve surface.

A magnet formed of samarium-cobalt metal alloy can also exert a magnetic force strong enough to retain the carrier grains 3*b* on the surface of the sleeve 4 even if its sectional area is small.

During development, a bias power supply or bias applying means 10 applies an AC-biased DC voltage for development to the sleeve 4 as an oscillating bias VB. A background potential VD in the non-image portion of the drum 1 and an image potential VL each are set between the maximum value and the minimum value of the bias VB. The oscillating bias VB forms an alternating electric in the developing zone D and thereby causes the toner grains 3*a* and carrier grains 3*b* to actively oscillate in the electric field. As a result, the toner grains 3*a* overcome electrostatic and magnetic restriction acting thereon toward the sleeve 4 and carrier grains 3*b* and selectively deposit on a latent image formed on the drum 1.

A difference between the maximum value and the minimum value of the bias VB, i.e., a peak-to-peak voltage should preferably be between 0.5 kV and 5 kV while the frequency of the bias VB should preferably be between 1 kHz and 10 kHz. The bias VB may have a rectangular, sinusoidal, triangular or similar waveform. While the DC component of the bias VB lies between the background potential VC and the image potential VL, it should preferably be closer to the background potential VC than to the image potential VL in order to avoid toner fog.

When the bias VB has a rectangular waveform, a duty ratio of 50% or below should be selected. The duty ratio refers to a ratio of a period of time over which the toner tends to move toward the drum to one period of the bias VB. A duty ratio of 50% or below successfully increases a difference between the peak value at which the toner tends to move toward the drum 1 and the time mean of the bias VB, thereby making the movement of the toner more active. It follows that the toner faithfully deposits on a potential distribution forming a latent image on the drum 1. This not only enhances a developing ability, but also improves granularity and resolution.

Further, the above duty ratio reduces a difference between the peak value at which the carrier grains 3*b* tend to move toward the drum 1 and the time mean of the bias VB, thereby settling the movement of the carrier grains 3*b*. Consequently, there can be obviated disturbance that would cause the tailing edge of an image to be lost. At the same time, there can be enhanced the reproducibility of thin lines and solitary dots. In addition, the probability that the carrier grains 3*b* deposit on the background of a latent image is noticeably reduced.

The operation of the developing device 2 will be described hereinafter. While the developer 3 deposited on the sleeve 4 in the developer chamber S is conveyed in accordance with the rotation of the sleeve 4, the doctor 6 regulates the thickness of the developer 3 to preselected thickness. The regulated developer 3 is conveyed to the developing zone D where the sleeve 4 faces the drum 1. In the developing zone D, the toner grains 3*a* are fed from the sleeve 4 to a latent image formed on the drum 1 to thereby produce a corresponding toner image. The developer 3 on the sleeve 4 and moved away from the developing zone D is further conveyed by the sleeve 4 to a position where it faces the opening 8*a*.

The fresh, magnetic toner grains 3*a* conveyed by the agitator 9, which is disposed in the toner hopper 8, to the opening 8*a* stay,in the opening 8*a* in contact with the developer 3. The developer 3 therefore takes in the fresh toner grains 3*a* at the opening 8*a* and then returns to the developer chamber S. In this manner, the illustrative embodiment effects self-control over the toner content of the developer 3.

Subsequently, on contacting the doctor 6, the developer 3 containing the fresh toner grains 3*a* has its internal pressure increased with the result that the toner grains 3*a* are charged by friction acting between them and the carrier grains 3*b*. Part of the developer 3 blocked by the doctor 6 is circulated within the developer chamber S.

Figure 12A:
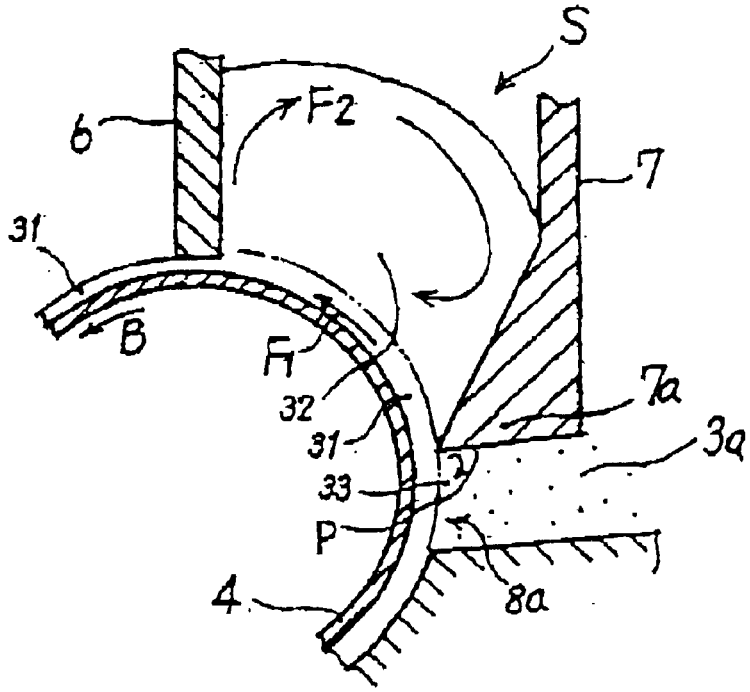
FIGS. 12A and 12B demonstrate self-control over the toner content of a developer unique to the developing device of FIG. 11.
Figure 12B:
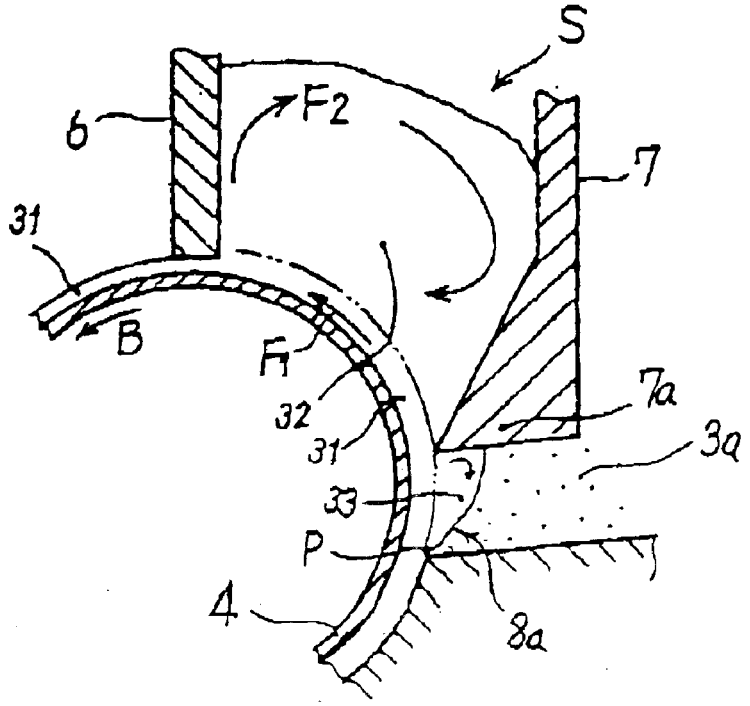

Reference will be made to FIGS. 12A and 128 for describing the automatic toner content control more specifically. In FIGS. 12A and 12B, dash-and-dots lines indicate the interface between different parts of the developer each behaving in a particular manner. First, a fresh developer 3 in which toner has a preselected content and a preselected weight is initially set in the developing device 2. In this condition, when the sleeve 4 is caused to rotate, the developer 3 separates into two parts 31 and 32. The developer 31 is magnetically deposited on the sleeve 4 and conveyed by the sleeve 4 while the developer 32 is stored in the developer chamber S and circulated therein in accordance with the movement of the developer 31.

As shown in FIG. 12A, the developer in the developer chamber S forms a first and a second flow F1 and F2, respectively. More specifically, the developer 31 forms the flow passing through the gap between the sleeve 4 and the predoctor 7*a*. The developer 32 forms the flow F2 rising along the back of the doctor 6 and being circulated between the doctor 6 and the predoctor 7*a*.

Subsequently, when fresh, magnetic toner grains 3*a* are set in the toner hopper 8, they are replenished to the developer 31 deposited on the sleeve 4 via the opening 8*a*. The developer 31 is then conveyed to the developer chamber S. At this instant, the toner grains 3*a* replenished to the developer 31 slightly move toward the axis of the sleeve 4. The developer 31 moved away from the predoctor 7*a* is partly mixed with the developer 32 existing in the developer chamber S. Consequently, the developers 31 and 32 are replaced with each other and uniformed due to the agitation of the toner grains while having the toner grains changed by friction.

As the toner content of the developer 3 increases little by little due to the replenishment of the toner grains 3*a*, the volume of the developer 31 being conveyed increases. Therefore, the developer 31 forming a layer on the sleeve 4 increases in thickness as it moves from the position of the opening 8*a* to the position of the doctor 6. At the same time, the ratio of the carrier grains 3*b* to the entire developer 31 and therefore the magnetic force acting on the developer 31 increases, so that the moving, speed of the developer 31 is lowered. Consequently, the thickness of the developer 31 on the sleeve 4 further increases between the two positions mentioned above. A braking force exerted by the doctor 6 on such a developer 31 being conveyed increases, further lowering the moving speed of the developer 3.

The upper portion of the developer 31 (boundary shown in FIG. 12A) increased in thickness at the position of the opening 8*a* is shaved off by the predoctor 7*a*. As shown in FIG. 12A, the developer so shaved off accumulates at the upstream side of the predoctor 7*a* in the direction of developer conveyance. Let this part of the developer be referred to as an accumulated developer 33. The accumulated developer 33 is circulated in accordance with the movement of the developer 31 contacting it. The toner grains 3*a* present in the opening 8*a* are attracted toward the exposed portion of the developer 31 and introduced into the developer 31 in such a manner as to be pulled in at a joining point J.

As shown in FIG. 12B, when the toner content of the developer 3 further increases, the accumulated toner 33 increases in amount and covers the exposed surface of the developer 31 contacting the fresh toner grains 3*a*. At the same time, the joining point J is shifted to the side upstream of the opening 8*a* in the direction of developer conveyance, and the circulation speed of the accumulated developer 33 in the opening 8*a* itself decreases. At this time, the replenishment of the toner grains 3*a* to the developer 31 substantially ends, so that the toner content of the developer 31 stops increasing.

Part of the developer 31 (upper portion) moved away from the gap between the predoctor 7*a* and the sleeve 4 is mixed with the developer 32 and again partly deposited on the sleeve 4. The developer 31 moved away from the gap between the sleeve 4 and the doctor 6 is conveyed to the developing zone D. In the developing zone D, the toner grains are transferred from the sleeve 4 to the drum 1, developing a latent image formed on the drum 1.

The toner content of the developer 31 on the sleeve 4 decreases in the developing zone D due to development. As a result, the conveying force of the sleeve 4 acting on the developer 31 and the volume of the developer 31 increase. It follows that the thickness of the developer 31 regulated by the edge of the predoctor 7*a* decreases, causing the amount and circulation speed of the accumulated developer 33 around the opening 8*a* to decrease. Consequently, the developer 31 being conveyed by the sleeve 4 and the fresh toner grains 3*a* again contact each other at the opening 8*a*, so that the toner content of the developer 3 again increases.

As stated above, in the illustrative embodiment, the condition in which the predoctor 7*a* regulates the developer 31 on the sleeve 4 varies in accordance with the toner content of the developer 3. The toner content of the developer is therefore automatically controlled to lie in a preselected range despite the consumption in the developing zone D. This makes a toner content sensor, a toner replenishing member and other extra members for toner content control needless.

If desired, a peeling member may be disposed in the developer chamber S in such a manner as to face the surface of the sleeve 4 for peeling off part of the developer 31 and mixing it with the developer 32 present in the chamber S. The peeling member promotes the replacement of the developers 3-1 and 3-2 for thereby slowing down the deterioration of the developer 3 ascribable to the fall of the chargeability of the carrier grains contained in the developer 3. Further, the mixture of the developers 31 and 32 uniforms the toner content of the developer in the direction perpendicular to the direction of developer conveyance by scattering the toner grains 3*a*, thereby implementing desirable development free form irregular image density.

Hereinafter will be described the composition of the developer with which the illustrative embodiment is practicable. The magnetic toner grains 3*a* used in the illustrative embodiment can be efficiently provided with a preselected grain size distribution if raw grains are classified into at least coarse grains, medium grains and fine grains by the inertia of the grains in an air stream and the centrifugal force of a rotation air stream based on the Coand effect. When the two-ingredient type developer is used as a color developer, magnetic toner grains 3*a* to be described layer should preferably be combined with magnetic carrier grains 3*b* having a mean grain size of 35 μm to 80 μm and coated mainly with silicone resin. Such a combination remarkably extends the life of the developer 3. While various methods are available for measuring the mean grain size of the carrier grains 3*a*, the illustrative embodiment uses the conventional classifying method or a method that analyzes randomly chosen 200 to 400 grains with an image analyzer.

While the grain size distribution of the toner grains 3*a* can be measure by any one of conventional methods, the illustrative embodiment uses Coulter Counter TA-II available from Coulter for measurement and an interface available from TEIKA SEIKI, which outputs a number distribution and a volume distribution, connected to a personal computer PC9801 available from NEC. For measurement, 0.1 ml to 5 ml of surfactant, e.g., alkylbenzenesulfonate is added to 10 ml to 15 ml of electrolytic aqueous solution as a dispersant. The electrolytic aqueous solution is an about 1% NaCl aqueous solution prepared by use of primary sodium chloride. Subsequently, 2 mg to 20 mg of sample to be measured is added to the above mixture. The electrolytic solution containing the sample is dispersed for 1 minute to 3 minutes by an ultrasonic dispersing device. The dispersed solution is then added to 100 ml to 200 ml of electrolytic aqueous solution prepared in another beaker such that it has a preselected content. Thereafter, the number-based grain size distribution of 2 μm to 40 μm grains is measured by Coulter Counter TA-II with an aperture of 100 μm. Finally, the volume distribution and number distribution of the 2 μm to 40 μm grains are calculated, and then a weight mean grain size (D4; the center of each channel is used as a representative) is determined.

Fluidizing agents applicable to the illustrative embodiment include oxides or composite oxides of, e.g., Si, Ti, Al, Mg, Ca, Sr, Ba, In, Ga, Ni, Mn, W, Fe, Co, Zn, Cr, Mo, Cu, Ag, V and Zr; two or more of them may be combined, if desired. Fine grains of, among such fluidizing agents, silicon dioxide (silica), titanium dioxide (titania) or alumina are preferable. The primary grain size of the fine grains should preferably be 0.1 μm or below. If desired, the surfaces of the fine grains may be processed by, e.g., a hydrophobicity agent.

Typical hydrophobicity agents include dimethylchlorosilane, trimethylchlorosilane, methyltrichlorosilane, aryldimethylchlorosilane, arylphenyldichlorosilane, benzildimethylchlorisilane, bromomethyldimethylchlorosilane, bromomethyldimethylchlorosilane, α-chloroethyltrichlorosilane, chloromethyldimethylchlorosilane, chromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyl-tris(β-methoxyethoxy) silane, Y-methacryloxypropyltrimethoxysilane, vinyltriacetoxysilane, vinyltriaceoxysilane, divinyldichlorosilane, dimetholvinylchlorosilane, octyltrichlorosilane, decyl-trichlorosilane, nonyl-trichlorosilane, (4-t-propylphenyl)-trichlorosilane, (4-t-butylphenyl)-trichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-otyl-dichlorosilane, dioctyl-dichlorosilane, didecenyl-dichlorosilane, dinonenyl-dichlorosilane, di-2-ehtylhexyl-dichlorosilane, di-3,3-dimethylbenthyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexaethyldisilazane, diethyltetramethyldisilazane, hexaphyldisilazane, and hexatryldisilazane. Also, titanate-based couplers and aluminum-based couplers are usable.

Among the fluidizing agents mentioned above, it was most effective from the environment stability and image density stability standpoint to use fine grains of hydrophobic silica having a grain size of 0.05 μm or below and fine grains of hydrophobic titanium oxide having a grain size of 0.05 μm or below. The ratio of the fluidizing agent to the toner grains 3*a* should preferably be 0.1 wt % to 2 wt %. Ratios less than 0.1 wt % fail to improve toner cohesion to an expected degree while ratios greater than 2 wt % cause the toner grains to be scattered between thin lines, smear the inside of the printer or bring about the scratches or the wear of the drum 1.

Other additives may be contained in the developer 3 so long as they do not adversely influence the developer 3. The other additives include Teflon powder, zinc stearate powder, polyvinylidenefluoride powder or similar lubricant powder, cerium oxide powder, silicon carbonate powder, strontium titanate powder or similar abrasive, carbon black powder, zinc oxide powder, tin oxide powder or similar conduction agent, and white fine grains and black fine grains of opposite polarities for enhancing the developing ability.

Binder resin for toner applicable to the illustrative embodiment may be selected from the conventional broad range of resins. For example, use may be made of polystyrene, poly-p-chlorostyrene, polyvinyltoluene or similar styrene monomer or a substitute thereof, a styrene-p-chlorostyrene copolymer, styrene-propylene copolymer, styrene-vinyltoluene copolymer, styrene-vinylnaphthalene copolymer, styrene-acrylate copolymer, styrene-methacrylate copolymer, styrene-acrylonitrile copolymer, styrene-vinylmethylether copolymer, a styrene-vinylethylether copolymer, styrene-vinylmethylketone copolymer, a styrene-butadien copolymer, styrene-isoprene copolymer, styrene-cyclonitrile-indene coplymer or similar styrene copolymer, acrylic resin, methacrylic resin, polyvinyl chloride, polyvinyl acetate, polyethylene, polypropylene, polyester resin, polyvinyl butyral, polyacrylate resin, rosin, modified rosin, terpene resin, phenol resin, natural resin-modulated phenol resin, natural resin-modulated maleic acid resin, polyurethane, polyamide resin, furan resin, epoxy resin, coumarone-indene resin, silicone resin, fatty acid resin or aromatic petroleum resin or a combination thereof. Among them, a styrene copolymer and polyester resin are desirable from the development and fixation standpoint.

Comonomers for styrene monomers of the styrene copolymer include acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate or similar monocarboxilic acid or a substitute thereof, maleic acid, butyl maleate, methyl maleate, methyl maleate, dimethyl maleate or similar dicarboxylic acid having double bond or a substitute thereof, vinyl chloride, vinyl acetate, vinyl benzoate or similar vinyl ester, ethylene, propylene, butylene or similar ethylene-based olefin, vinylmethylketone, vinylhexylketone or similar vinyl ketone, and vinylmethylether, vinylisobutyleter or similar vinyl ether. Two or more of such monomers may be used in combination.

The polyester resin mentioned above may be produced by any conventional synthesizing method by use of an alcohol component and an acid component. The alcohol component may be selected from a group of diols including polyethylene glycol, diethylene glycol, triethylene glycol, 1,2-propylene glycol, 1,3-propylene glycol, 1,4-propylene glycol, neopentyl glycol and 1-4-butene diol, a group of etherified bisphenols including 1,4-bis(hydroxymethyl) cyclohexane, bisphenol A, hydrogen-added bisphenol A, polyoxyethylenated bisphenol A and polyoxypropoylated bisphenol A, a group of bivalent alcohol monomers produced by replacing the above components with a saturated or unsaturated hydrocabon group having three to twenty-two carbon atoms, a group of other bivalent alcohol monomers, and a group of trivalent and other multivalent alcohols including sorbitol, 1,2,3,6-hexatetrol, pentaesrytol, dipentaesrytol, tripendaesrytol, 1,2,4-butanetriol, 2-methyl-1,2,4-butanetriol, trimethylolethane, trimethylolpropane and 1,3,5-trihydroxymethylbenzene.

The acid component mentioned above may be any one of palmitic acid, stearic acid, oleic acid or similar monocarboxylic acid, maleic acid, fumaric acid, mesaconic acid, citraconic acid, itaconate, phthalic acid, isophthalic acid, terephthalic acid, cyclohexane dicarbonate, succinic acid, adipic acid, maroic acid, a bivalent organic acid produced by replacing such an acid with a saturated or unsaturated hydrocarbon group having three to twenty-two carbon atoms, an anhydride of such an acid, a dimer of lower alkylester trinoleic acid, other bivalent organic acid monomers, 1,2,4-benzene tricarboxilic acid, 1,2,4-cyclohexane tricarboxilic acid, 2,5,7-naphalene tricarboxilic acid, 1,2,4-trinaphthalene carboxilic acid, 1,2,4-butane tricarboxilic acid, 1,2,5-hexane tricarboxilic acid, 1,3-dicarboxil-2-methyl-2-methylenecarboxypropane, tetra (methylenecarboxyl)methane, and a trivalent or other multivalent carboxilic acid monomer of, e.g., an unhydride of such an acid.

Pigments applicable to the illustrative embodiment are as follows. Black pigments include carbon black, oil furnace black, channel black, lamp black, acetylene black, Aniline Black and other azine pigments, metal salt azo pigments, metal oxides, and composite metal oxides.

Yellow pigments include cadmium yellow, Mineral Fast Yellow, Naphtol Yellow S, Hansa Yellow G, Hansa Yellow 10G, Benzidine Yellow GR, Quinoline Yellow Rake, and Permanent Yellow NCG.

Orange pigments include molybdenum orange, Permanent Orange GTR, pyrazolone ornage, Vulcan Orange, Indanthrene Brilliant Orange RK, Benzidine Orange G, Indanthrene Brilliant Orange GK.

Red pigments include blood red, cadmium red, Permanent Red 4R, pyrazolone red, Watching Red Calcium Salt, Rake Red D, Brilliant Carmine 6B, Eosine Rake, Rhodamine Rake B, Alizarin Rake, and Brilliant Carmine 3B.

Violet pigments include Fast Violet B and Methyl Violet Rake. Blue pigments include cobalt blue, alkali blue, Victoria Blue Rake, phthalocyanine blue, metal-free phthalocyanine blue, Fast Sky Blue, and Indanthrene Blue BC. Further, green pigments include chrome green, chromium oxide, Pigment Green B, and malachite green rake. One or more of such pigments may be used.

A parting agent may be added to the toner grains 3*a* of the illustrative embodiment in order to obviate offset during fixation. The parting agent may be any one of conventional waxes including carnauba wax, rice wax and other natural waxes, paraffin wax, polyethylene of low molecular weight, polypropylene of low molecular weight, and ester alkylate. The parting agent is selected in matching relation to the binder resin and the material forming the surface of a heat roller. The parting agent should preferably have a melting point of 65° C. to 90° C. Melting points lower than 65° C. are apt to bring about toner blocking when the toner is stored, while melting points higher than 90° C. are apt to bring about offset in the low temperature range of the heat roller.

In the illustrative embodiment, a charge control agent should preferably be contained in or coated on the surfaces of the toner grains 3*a*. The charge control agent implements optimal control over the amount of charge in matching relation to the development system. Particularly, when the toner content is controlled by self-control as in the illustrative embodiment, a charge control agent is desirable.

A polarity control agent applicable to the illustrative embodiment may be any one of conventional polarity control agents. A polarity control agent charging the toner grains 3*a* to positive polarity may be selected from a group of substances modified by, e.g., nigrosine or fatty acid metal salt, a group of quaternary ammonium salts including tetrabutylammonium tetrafluoroborate, diorgano tin oxides including dibutyl tin oxide, dioctyl tin oxide and dicyclohexyl tin oxide, and a group of diorgano tin borates including dibutyl tin borate, dioctyl tin borate and dicyclohexyl tin borate. Such substances may be used either singly or in combination. Among them, nigrosine compounds and organic quaternary ammonium salts are particularly desirable.

A polarity control agent charging the toner grains 3*a* to negative polarity is advantageously implemented by, e.g., an organic metal compound or a chelate compound typified by aluminum acetylacetonate, iron(II) acetylacetonate, 3,5-ditertially-butylchrome salycilate. Particularly, an acetylacetone metal complex, a monoazo metal complex or a metal complex or a salt of naphtoic acid or salcilic acid is preferable. A salycilic acid metal complex, a monoazo metal complex or a salycilic metal salt is more preferable.

The polarity control agent mentioned above should preferably be used in the form of grains as fine as 3 $\mu$m or below in terms of number mean grain size. The content of the polarity control agent is dependent on the kind of the binder resin, whether or not additives are used, and the method of producing toner including the dispersing method. Preferably, the content of the polarity control agent should be between 0.1 parts by weight and 20 parts by weight, more preferably between 0.2 parts by weight and 10 parts by weight. Contents below 0.1 parts by weight make the amount of charge of the toner grains 3*a* short in practical use. Contents above 20 parts by weight make the amount of charge of the toner grains 3*a* excessive and increase the electrostatic attraction between the toner grains 3*a* and the carrier grains 3*b*, thereby lowering the fluidity of the developer 3 and image density.

As for the magnetic substance of the toner grains 3*a*, use may be made of magnetite, hematite, ferrite or similar iron oxide, iron, cobalt, nickel or similar metal, an alloy of such metal and aluminum, cobalt, copper, lead, magnesium, tin, zinc, antimony, beryllium, bismuth, cadmium, calcium, manganese, selenium, titanium, tungsten, vanadium or similar metal or a mixture thereof. Among them, magnetite is useful. A specific method of producing magnetite grains consists in neutralizing an aqueous solution of iron sulfate with an alkaline aqueous solution to thereby prepare iron hydroxide, adjusting the aqueous solution of iron hydroxide to pH of 10 or above, oxidizing the adjusted solution with oxygen-containing gas to thereby produce a magnetite slurry, and then rinsing, filtering, drying and pulverizing the slurry.

The above magnetic substance should preferably have a mean grain size of 0.01 $\mu$m to 1 $\mu$m, more preferably 0.1 $\mu$m to 0.5 $\mu$m. The content of the magnetic substance to the toner 3*a* should preferably be 5 wt % to 80 wt %, more preferably 10 wt % to 60 wt %.

In the illustrative embodiment, the magnetization strength of the toner grains 3*a* is adjusted to satisfy the following conditions. In a magnetic field of 5 kOe, e.g., $5\times10^6/4\pi$ A/m, the magnetization strength is 10 emu/g to 25 emu/g, i.e., $10\times10^{-7}\times4\pi$ Wb.m/kg to $25\times10^{-7}\times4$ Wb.m/kg, preferably 15 emu/g to 20 emu/g, i.e., $15\times10^{-7}\times4\pi$ Wb.m/kg to $20\times10^{-7}\times4\pi$ Wb.m/kg. In a magnetic field of 1 kOe, i.e., $1\times10^6/4\pi$ A/m, the magnetization strength is between 7 emu/g and 20 emu/g, i.e., $7\times10^{-7}\times4\pi$ Wb.m/kg and $20\times10^{-7}\times4\pi$ Wb.m/kg, preferably between 10 emu/g and 17 emu/g, i.e., $10\times10^{-7}\times4\pi$ Wb.m/kg and $17\times10^{-7}\times4\pi$ Wb.m/kg. More specifically, the above magnetization strength in the magnetic field of $5\times10^6/4\pi$ A/m is selected to be a saturation magnetization value. The toner grains are controlled on the basis of a magnetization curve in which the magnetization strength in the field of $1\times10^6/4\pi$ A/m appears before the saturation magnetization value.

As for the magnetic carrier grains 3*b* applicable to the illustrative embodiment, use may be made of iron powder, ferrite powder, nickel powder, magnetite powder or similar magnetic grains that are coated or not coated with resin, or resin grains in which magnetic grains are dispersed. The carrier grains 3*b* should preferably have a mean grain size of 35 $\mu$m to 80 $\mu$m.

Resin for coating the carrier grains 3*b* may be selected from a group of polyolefin resins including polyethylene, polypropylene, chlorinated polyethylene and chlorosulfonated ethylene, a group of polyvinyls and polyvinylidene resins including polystyrene, acryl (e.g. polymethyl methacrylate), polyacrylonitril, polyvinyl acetate, polyvinyl alcohol, polyvinyl butyral, polyvinyl chloride, polyvinyl carbozol, polyvinyl ether and polyvinyl ketone, a group of fluoric resins including vinyl chloride-vinyl acetate copolymer, polytetrafluoroethylene, polyvinyl fluoride, polyvinylidene fluoride and polychlorotrifluoroethylene, a group of amino resins including polyamide, polyester, polyurethane, plycarbonate and urea-formaldehyde resin, epoxy resins, and silicone resins. Magnetic grains coated with silicone resin or silicone resin containing carbon black are desirable in the aspect of toner spent. Such silicone resin may any one of conventional silicone resins, e.g., straight silicone having only organosiloxane bond represented by a formula (1) shown in FIG. 13 or silicone resin modulated by alkyd, polyester, epoxy or urethane.

Figure 13:
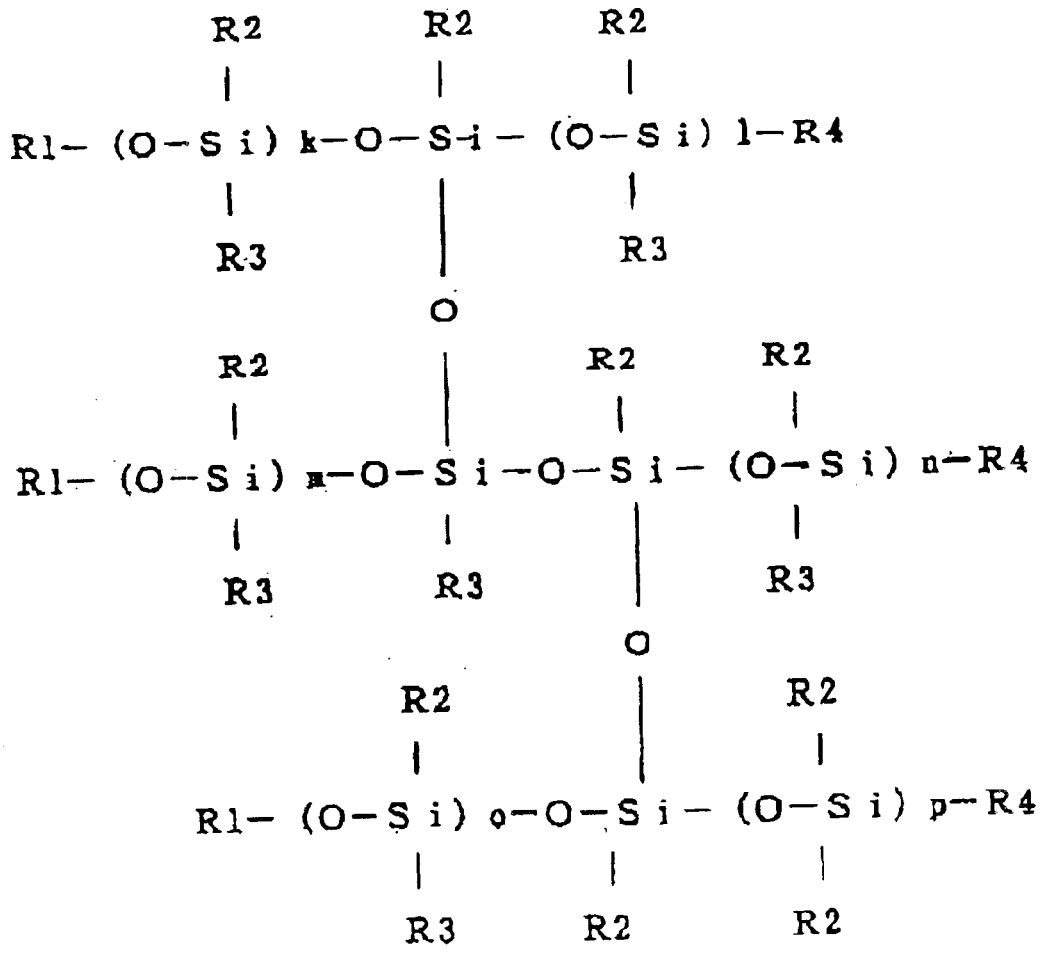
FIGS. 13, 14 and 15 show chemical formula (1), (2) and (3), respectively.
Figures 14, 15:
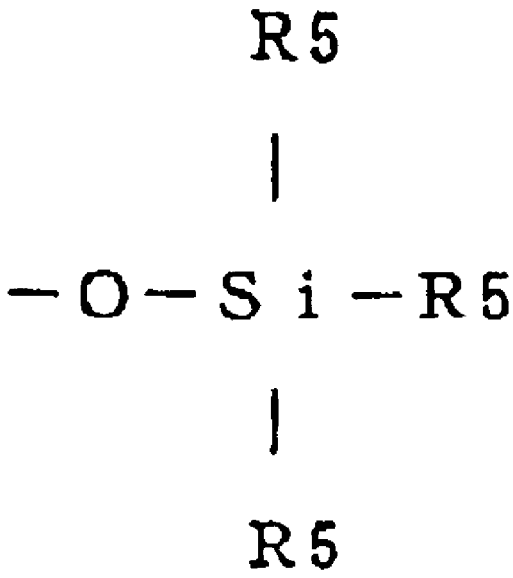

The formula (1) of FIG. 13 includes R1 representative of an alkyl group or a phenyl group having one to four carbon atoms, R2 and R3 representative of a hydrogen group, an alkoxy group having one to four carbon atoms, a phenyl group, a phenoxy group, an alikenyl group having two to four carbon atoms, an alkenyloxy group having two to four carbon atoms, a hydoxy group, a carboxil group, an ethylene oxide group, a glycidyl group or a group represented by a formula (2) shown in FIG. 14.

In the formula (2), R4 and R5 are representative of a hydroxy group, carboxyl group, an alkyl group having one to four carbon atoms, an alkoxy group having one to four atoms, an alkenyl group having two to four carbon atoms, an alkenyloxy group having two to four carbon atoms, a phenyl group or a phenoxy group; k, l, m, o and p each are 1 or greater integer.

The substituents mentioned above each may be non-substituted or include a substituent, e.g., an amino group, a hydroxy group, a carboxyl group, a mercapto group, an alkyl group, a phenyl group, an ethylene oxide group, a glycidyl group or a halogen atom.

If the coating layer covering each carrier grain 3*b* contains carbon black, then there can be implemented desired electric resistance. Carbon black may be any one of conventional carbon black including furnace black, acetylene black, and channel black. Particularly, a mixture of furnace black and acetylene black allows, if added in a small amount, conductivity to be effectively adjusted and provides the coating layer with high wear resistance. Carbon black should preferably have a grain size of 0.01 $\mu$m to 10 $\mu$m and should preferably be added by 2 parts by weight to 30 parts by weight, more preferably 5 parts by weight to 20 parts by weight, for 100 parts by weight of the coating resin.

Further, the coating layer on the individual carrier grain 3*b* may contain a silane coupler, titanium coupler or similar coupler in order to enhance adhesion to the core grain and dispersion of the conduction agent. The silane coupler is a compound represented by a general formula (3) shown in FIG. 15. In the formula (3), X is representative of a hydrolyzable group bonded to silicon atoms, e.g., a chloro group, an alcoxy group, an acetoxy group, an alkylamino group or a propenoxy group. Y is representative of an organic functional group reactive to an organic matrix, e.g., a vinyl group, a methacryl group, an epoxy group, a glycidoxy group, an amino group or a mercapto group. R is representative of an alkyl group or an alkylene group having one to twenty carbon atoms.

Among the various silane couplers, an aminosilane coupler whose Y is an amino group is particularly desirable in implementing a developer chargeable to negative polarity. As for a developer chargeable to positive polarity, an epoxysilane coupler whose Y is an epoxy group is preferable.

To form the coating layer on the individual carrier grain 3*b*, a coating layer forming liquid should only be applied to the core grain by spraying, dipping or similar conventional technology. The coating layer should preferably be 0.1 $\mu$m to 20 $\mu$m thick.

A specific method of producing a two-ingredient type developer applicable to the illustrative embodiment will be described hereinafter. First, the binder resin, colorant, which is a pigment or a dye, charge control agent, lubricant and other additives stated above are sufficiently mixed by a Henschel mixer or similar mixer, sufficiently kneaded by any one of conventional thermal kneaders, cooled, and then roughly pulverized by, e.g., a hammer mill. In the case of a color developer, it is a common practice to enhance the dispersion of the pigment by using as a colorant a master batch prepared by melting and kneading part of the binder resin and pigment beforehand.

Subsequently, rough grains produced by the mill are finely pulverized by a mill and/or a mechanical pulverizer. The resulting fine grains are classified into preselected grain sizes by a classifier using a rotation air stream or the Coand effect. A classifier using the Coand effect is suitable for the grain size distribution of the toner grains 3*a* particular to the illustrative embodiment. Subsequently, the toner grains are sufficiently mixed to the fluidizing agent by a Henschel mixer or similar mixer and then passed through a screen of 250 mesh or above, so that rough grains and cohered grains are removed.

The results of experiments conducted with the developing device 2 of the illustrative embodiment and a plurality of developers 3 to estimate images will be described hereinafter. First, examples of a procedure for producing the developer particular to the illustrative embodiment and comparative examples will be described.

Example 1

In Example 1, 100 parts by weight of polyester resin, 3 parts by weight of chromium-containing azo dye, 23 parts by weight of fine magnetite grains and 5 parts by weight of polypropylene were mixed by a Henschel mixer. The resulting mixture was kneaded by a kneader and then solidified by cooling. The solidified mixture was roughly pulverized by a cutter mill and then finely pulverized by a mechanical mill. The resulting fine grains were classified by a multidivision classifier such that grains having grain sizes of 5 μm and below occupied 51.4 number % of the entire grains. Such grains were used as mother grains. 0.6 parts by weight of hydrophobic silica having a mean grain size of 0.3 μm was added to 100 parts by weight of mother grains and then mixed by a Henschel mixer to thereby produce magnetic toner grains a.

As for the magnetic carrier, 100 parts by weight of silicone resin (organostraight silicone), 100 parts by weight of toluene, 5 parts by weight of Y-(2-aminoethyl) aminopropyltrimethoxysilane and 10 parts by weight of carbon black were mixed and then dispersed in a homomixer for 20 minutes to thereby prepare a coating, liquid. Subsequently, the coating liquid was coated on 1,000 parts by weight of spherical magnetite grains by a fluid-bed type coater, thereby producing magnetic carrier grains A.

90 parts by weight of the above carrier A and 10 parts by weight of the above toner a were mixed by a turbuler mixer to thereby complete a two-ingredient type developer.

Example 2

In Example 2, 0.6 parts by weight of hydrophobic silica having a mean grain size of 0.3 μm and 0.3 parts by weight of hydrophobic titanium oxide were added to the mother grains prepared in Example 1 and then mixed by the Henschel mixer to thereby produce magnetic toner grains b. Subsequently, 10 parts by weight of toner grains b and 90 parts by weight of carrier grains A prepared in Example 1 were mixed by a tubuler mixer for thereby completing a two-ingredient type developer.

Example 3

Example 3 produced magnetic toner grains c in the same manner as Example 2 except that grains of having grain sizes of 5 μm and below occupied 41.2 number % of the entire grains. 10 parts by weight of the toner grains c was mixed with 90 parts by weight of the carrier grains A produced in Example 1 by a turbuler mixer to thereby produce a two-ingredient type developer.

Example 4

Example 4 produced magnetic toner grains d in the same manner as Example 2 except that grains of having grain sizes of 5 μm and below occupied 62.1 number % of the entire grains. 10 parts by weight of the toner grains d were mixed with 90 parts by weight of the carrier grains A produced in Example 1 by a turbuler mixer to thereby produce a two-ingredient type developer.

Example 5

Example 5 produced magnetic toner grains e in the same manner as Example 2 except that grains of having grain sizes of 5 μm and below occupied 75.6 number % of the entire grains. 10 parts by weight of the toner grains e were mixed with 90 parts by weight of the carrier grains A produced in Example 1 by a turbuler mixer to thereby produce a two-ingredient type developer.

Example 6

In Example 6, 100 parts by weight of polyester resin, 3 parts by weight of chromium-containing azo dye, 30 parts by weight of fine magnetite grains and 5 parts by weight of polypropylene were mixed by a Henschel mixer, kneaded by a kneader at 180° C., and then solidified by cooling. Subsequently, the solidified mixture was roughly pulverized by a cutter mill and then finely pulverized by a mechanical mill. The resulting fine grains were classified by a rotation air stream classifier such that grains having grain sizes of 5 μm and below occupied 55.7 number % of the entire grains, thereby producing mother grains. 0.5 part by weight of hydrophobic silica having a mean grain size of 0.3 μm and 0.3 part by weight of hydrophobic titanium oxide were added to 100 parts by weight of the mother grains and then mixed by a Henschel mixer for thereby producing magnetic toner grains f. Subsequently, 10 parts by weight of the toner grains f and 90 parts by weight of the carrier grains A produced in Example 1 were mixed by a turbuler mixer to thereby produce a two-ingredient type developer.

Comparative Example 1

In Comparative Example 1, 100 parts by weight of polyester resin, 3 parts by weight of chromium-containing azo dye, 50 parts by weight of fine magnetite grains and 5 parts by weight of polypropylene were mixed by a Henschel mixer, kneaded by a kneader at 180° C., and then solidified by cooling. Subsequently, the solidified mixture was roughly pulverized by a cutter mill and then finely pulverized by a mechanical mill. The resulting fine grains were classified by a rotation air stream classifier such that grains having grain sizes of 5 μm and below occupied 32.3 number % of the entire grains, thereby producing mother grains. 0.5 part by weight of hydrophobic silica having a mean grain size of 0.3 μm and 0.3 part by weight of hydrophobic titanium oxide were added to 100 parts by weight of the mother grains and then mixed by a Henschel mixer for thereby producing magnetic toner grains g. Subsequently, 10 parts by weight of the toner grains g and 90 parts by weight of the carrier grains A produced in Example 1 were mixed by a turbuler mixer to thereby produce a two-ingredient type developer.

Comparative Example 2

In Comparative Example 2, 100 parts by weight of polyester resin, 3 parts by weight of chromium-containing azo dye and 5 parts by weight of polypropylene were mixed by a Henschel mixer, kneaded by a kneader at 180° C., and then solidified by cooling. Subsequently, the solidified mixture was roughly pulverized by a cutter mill and then finely pulverized by a mechanical mill. The resulting fine grains were classified by a pivoted air-classifying device such that grains having grain sizes of 5 μm and below occupied 83.1 number % of the entire grains, thereby producing mother grains. 0.3 part by weight of hydrophobic silica having a mean grain size of 0.3 μm and 0.3 part by weight of hydrophobic titanium oxide were added to 100 parts by weight of the mother grains and then mixed by a Henschel mixer for thereby producing magnetic toner grains h. Subsequently, 10 parts by weight of the toner grains h and 90 parts by weight of the carrier grains A produced in Example 1 were mixed by a turbuler mixer to thereby produce a two-ingredient type developer.

FIG. 16 is a table comparing Examples 1 through 6 and Comparative Examples 1 and 2 as to number % of the grains having grain sizes of 5 μm and below, magnetization strength in the magnetic fields of $1\times10^6/4\pi$ A/m and $5\times10^6/4\pi$ A/m, composition of the coating layer of the carrier, and kind of the fluidizing agent.

Figure 17:
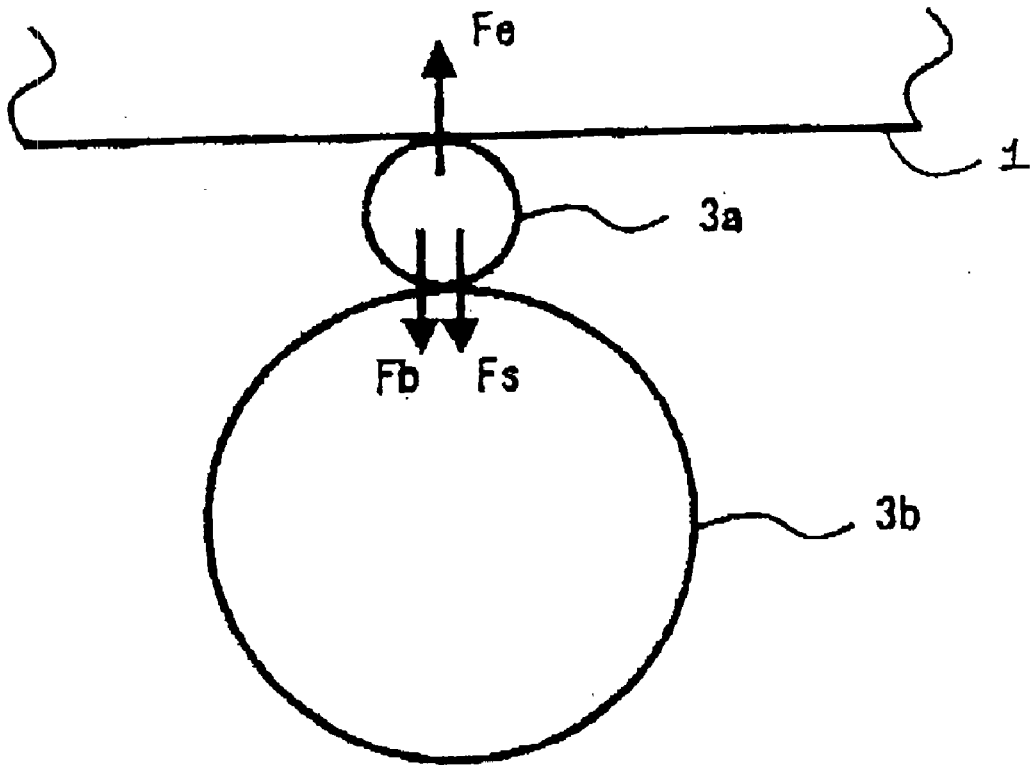
FIG. 17 shows forces to act between a photoconductive drum, a magnetic toner grain and a magnetic carrier grain.

The construction of a printer used for experiments will be described hereinafter. FIG. 17 shows forces acting between the drum 1, the magnetic toner grain 3*a*, and the magnetic carrier grain 3*b*. As shown, a force Fe derived from an electric field, an electrostatic force Fs and a magnetic force Fb act on the toner grain 3*a*, between the toner grain 3*a* and the carrier grains 3*b* and on the toner grain 3*a*, respectively, as indicated by arrows. The magnetic force Fb pulls the toner grain 3*a* toward the sleeve 4. A force ascribable to toner drift stated earlier may be regarded as an increment a of the electrostatic force Fs; when toner drift occurs, the force Fs is Fs+α and tends to return the toner grain 3*a* toward the carrier grain 3*b*. Further, as the shape of the toner grain 3*a* becomes more spherical, the grain 3*a* moves more easily on the carrier grain 3*b*, aggravating toner drift. In the case of a nonmagnetic toner grain, the magnetic force Fb does not act on the toner grain. Therefore, the magnetic toner grain 3*b* attracted by the carrier grain 3*b* due to the magnetic force Fb is more likely to bring about the omission of the trailing edge of a solid image or that of a halftone image than a nonmagnetic toner and is inferior to a nonmagnetic toner in the reproducibility of fine lines and solitary dots.

In light of the above, in the illustrative embodiment, the flux density normal to the surface of the sleeve 4 and generated by the main pole P1 is provided with a peak value having an attenuation ratio of 50%, as stated earlier. Such an attenuation ratio successfully makes the magnet brush MB short enough to reduce the width of the developing zone D in the direction of rotation of the sleeve 4, thereby reducing toner drift. In addition, the above attenuation ratio makes the magnet brush MB in the developing zone D dense and thereby causes it to uniformly rise on the sleeve 4 over the entire axis of the sleeve 4 and move into or out or contact with the drum 1, as shown in FIG. 8A. Consequently, as shown in FIG. 8B, even the magnetic toner grains 3*a* free a solid image from the omission of the trailing edge for thereby improving image quality.

Increasing the attenuation ratio of the flux density in the normal direction, as stated above, is a specific configuration capable of reducing the width of the developing zone D and thereby reducing toner drift. Alternatively, as shown in FIG. 7, the angle θ1 between the pole transition points where the normal flux density is 0 mT may be reduced to 40° or below. This is also successful to reduce the width of the developing zone D for thereby improving image quality despite the use of the magnetic toner grains 3*a*. Further, as shown in FIG. 6, the half-value angle θ2 of the maximum normal flux density Bn may be reduced to 20° or below.

Experiment 1

In Experiment 1, images were estimated by using the developers produced by Examples 1 through 6 and Comparative Examples 1 and 2 and the developing device 2 of the illustrative embodiment. Experiment 1 was conducted under the conditions listed in FIG. 18. Flux density was measured by a gauss meter HGM 8300 and an axial probe Type A1 available from ADS and was recorded by a circle chart recorder.

Under the conditions shown in FIG. 18, the attenuation ratio of the peak value of the normal flux density Bn was varied in order to estimate images by the following method. More specifically, images were compared as to the amount of omission of a trailing edge occurred in a halftone solid image, reproducibility of 1,200 dpi dots, irregularity in image density, and image density controllability. FIG. 19 shows the results of estimation.

In FIG. 19, as for the omission of the trailing edge, double circles and circles are representative of the amounts of omission between 0 mm and 0.4 mm that are desirable. Crosses and triangles indicate amounts of omission of 0.8 mm and above, which are not acceptable at all, and medium amounts of omission, respectively. As for the reproducibility of 1,200 dpi dots, double circles and circles are representative of reproducibility of 70% and above, which are desirable, while crosses and triangles are representative of reproducibility of 30% and below, which are not acceptable at all, and medium reproducibility, respectively.

To determine image density controllability, twenty, 100% solid images having density of 1.6 each were continuously printed in order to estimate the resulting image density. Double circles are representative of image density differences of less than 0.1 while circles are representative of image density differences of 0.1 and above, but below 0.2. Triangles and crosses are representative of image density differences of 0.2 and above, but below 0.5, and image density differences of 0.5 and above, respectively.

To determine the irregularity of image density, image density was measured by a Macbeth densitometer at three positions of the upper, middle and lower portions of an image, i.e., nine positions in total, and then a difference between the maximum density and the minimum density was determined to be irregularity. Double circles are representative of irregularity of less than 0.1 while circles are representative of irregularity of 0.1 and above, but below 0.2. Triangles and crosses are is representative of irregularity of 0.2 and above, but below 0.5, and irregularity of 0.5 and above, respectively.

As FIG. 19 indicates, when use is made of fine, magnetic toner grains and when the attenuation ratio of the peak value of the normal flux density Bn is 50% or above, it is possible to reproduce 1,200 dpi dots, lower the degree of the omission, and implement desirable image density controllability and irregularity.

Experiment 2

Experiment 2 is identical with Experiment 1 except that the angle θ1 between the pole transition points where the flux density is 0 mT was varied. The results of experiments were shown in FIG. 20. As FIG. 20 indicates, when the angle θ1 is 40° or below, the magnetic toner grains 3*a* can reproduce 1,200 dpi dots, lower the degree of the omission, and implement desirable image density controllability and irregularity.

Experiment 3

Experiment 3 is also identical with Experiment 1 except that the half-value angle θ2 of the normal flux density distribution was varied. The results of experiments were shown in FIG. 21. As FIG. 21 indicates, when the angle θ2 is 20° or below, the magnetic toner grains 3*a* can reproduce 1,200 dpi dots, lower the degree of the omission, and implement desirable image density controllability and irregularity.

As stated above, the developing device 2 of the illustrative embodiment can reduce toner scattering and obviate the omission of a trailing edge and other image defects even when the linear velocity of the sleeve 4 is increased, and can reproduce dots whose resolution is as high as 1,200 dpi.

Further, the developing device 2 can automatically control the toner content of the developer 3 without resorting to a toner replenishing mechanism or a toner content sensor. The developing device 2 is therefore miniature and low cost. Particularly, because the magnetic toner grains 3*a* have magnetization strength stated earlier, they have desirable fluidity and can be efficiently transferred from the hopper 8 to the developer 3. This prevents image density from being lowered when an image of the kind consuming much toner is repeatedly formed.

Figures 22, 23:
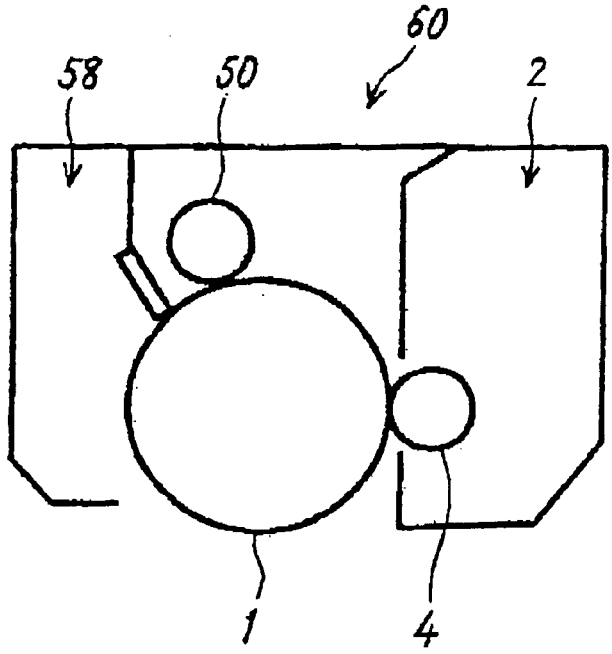
FIG. 22 shows a specific configuration of a process cartridge in accordance with the present invention.
FIG. 23 is a table listing exemplary procedures for producing toner grains a through h particular to a second embodiment of the present invention.

If desired, the developing device 2 can be constructed into a single process unit, which is removable from the printer body, together with at least one of the drum 1, charge roller 50, and cleaning unit 58. FIG. 22 shows a specific process cartridge including all of the drum 1, charge roller 50, cleaning unit 58, and developing device 2.

An alternative embodiment of the present invention will be described hereinafter. It is to be noted that the configurations of FIGS. 10 through 15, 17 and 18 described in related to the previous embodiment apply to the alternative embodiment also and will not be described specifically in order to avoid redundancy. First, a developer applicable to the illustrative embodiment will be described. Circularity to be discussed later is measured by a flow type, grain image analyzer FPIA-1000 available from SYSMEX although such an analyzer is only illustrative.

Spherical magnetic toner applicable to the illustrative embodiment should preferably have magnetization strength of 10 emu/g to 30 emu/g, more preferably 15 emu/g to 25 emu/g, in a magnetic field of 1,000 Oe. Magnetization strength below 10 emu/g reduces the magnetic bias effect to act on the toner grains, bringing about toner scattering and background contamination. Magnetization strength above 30 emu/g increases the above effect and thereby lowers image density.

Magnetic grains applicable to the illustrative embodiment should preferably contain 10 wt % to 25 wt % of FeO, more preferably 15 wt % to 25 wt % of FeO, and should preferably have a specific surface area of 1 $m^2/g$ to 60 $m^2/g$, more preferably 3 $m^2/g$ to 20 $m^2/g$. The FeO content and specific surface area lying in the above ranges satisfy both of the resistance and chargeability required of the toner grains for thereby insuring images with high density and free from background contamination.

The toner grains applicable to the illustrative embodiment may be produced by any one of conventional methods. For example, use may be made of a method consisting in melting and kneading a mixture of binder resin, magnetic substance and polarity control agent with or without additives by use of a heat roll mill, solidifying the mixture by cooling, and pulverizing and classifying the resulting grains. Additives may be coated on the classified grains.

The binder resin may be any one of conventional binder resins. For example, the binder resin may be selected from a group of styrene monomers and derivatives thereof including polystyrene, poly-p-chlorostyrene and polyvinyl toluene, a group of styrene copolymers including styrene-p-chlorostyrene copolymer, styrene-vinyltoluene copolymer, styrene-methacrylate copolymer, styrene-α-methylmethacrylate copolymer, styrene-acrylonitril ether copolymer, styrene-vinylmethylketone copolymer, styrene-budadient copolymer, styrene-isoprene copolymer, styrene-acrylonitrile-isoprene copolymer and styrene-acrylonitril-indene copolymer, polyvinyl chloride, phenol resin, natural modulated phenol resin, maleic resin modulated by natural resin, acrylic resin, methacrylic resin, polyvinyl acetate, silicone resin, polyester resin, polyurethane, polyamide resin, furan resin, epoxy resin, xylene resin, polyvinyl butyral resin, rosin, modulted rosin, terpen resin, coumarone and indene resin, aliphatic resin or aliphatic hydrocarbon resin, aromatic petroleum resin, paraffin chloride, and paraffin wax. Such binder resins may be used either singly or in combination.

Particularly, in the case of fixation using heat and pressure, the binder implemented by polyester resin makes the toner grains highly resistive to adhesion to a vinyl chloride mat, i.e., offset to a heat roller. For example, use may be made of polyethylene, polypropylene, polyurethane elastomer, ethylene-ethylacrylate copolymer, ethylene-vinylacetate copolymer, ionomer resin, styrene-budadien copolymer, styrene-isoplene copolymer, linear saturated polyester or paraffin.

A charge control agent should preferably be contained in or coated on the toner grains, so that the amount of charge can be optimally controlled in matching relation to the development system. Particularly, the charge control agent allows a developing method that does not control the toner content stated earlier to be effectively applied to the illustrative embodiment.

A polarity control agent for the toner grains may be any one of conventional polarity control agents. A polarity control agent for charging the toner grains to positive polarity may be selected from a group of modifications modified by, e.g., nigrosine or aliphatic metal salt, a group of quaternary ammonium salts including tributylbenzilammonium-1-hydroxy-4-naphtosulphonate and tetrabutylammonium tetrafluoroborate, a group of diorgano tin oxides including dibutyl tin oxide, dioctyl tin oxide and dicyclohexyl tin oxide, and a group of diorgano tin borates including dibutyl tin borate, dioctyl tin borate and dicyclehexyl tin borate. Such polarity control agents may be used either singly or in combination. Particularly, a nigrosine compound, organic quaternary ammonium salt or similar polarity control agent is desirable.

A polarity control agent for charging the toner grains to negative polarity should preferably be implemented by, e.g., an organic metal compound or a chelate compound. For example, use may be made of aluminum acetylacetate, iron(II) acetylacetate or 2,5-zeta-epsomite-butylchrom salcynate. An acetylacetone metal complex, a monoazo metal complex or a metal complex or a salt of naphthoe acid or salcylic acid, particularly a salcylic metal comkplex, a monoazo metal complex or a salcylic metal salt, is desirable.

The polarity control agent should preferably be implemented as fine grains having a number mean grain size of, e.g., 3 μm or below. The amount of polarity control agent for the toner grains is dependent on the method of producing the toner, e.g., kind of the binder, whether or not additives are used and the dispersing method. The polarity control agent should preferably be used in an amount of 0.1 part by weight to 20 parts by weight, more preferably 0.2 part by weight to 10 parts by weight, for 100 parts by weight of binder. An amount below 0.1 part by weight makes the amount of charge to deposit on the toner grains short in practical use. An amount above 20 parts by weight makes the amount of toner excessive and thereby intensifies electrostatic attraction between the toner and the carrier, resulting in low fluidity and low image density.

A magnetic substance for the magnetic toner grains may be any one of magnetite, hematite, ferrite or similar magnetic iron oxide, iron, cobalt nickel or similar magnetic metal, or a composite metal oxide alloy or a mixture of iron oxide or magnetic metal and cobalt, tin, titanium, copper, lead, zinc, magnesium, manganese, aluminum, silicon or similar metal. If desired, carbon black or similar colorant may be coated on the magnetic grains with a silane coupler serving as a binder. The silane coupler should be used in an amount of 0.3 part to 3.0 parts by weight, preferably 0.3 part by weight to 1.5 parts by weight, for the magnetic iron oxide grains. An amount below 0.3 part by weight prevents the colorant from firmly adhering to the magnetic grains and thereby causes the colorant to leave the magnetic grains during dispersion, resulting in fog and other problems. An amount above 3 parts by weight makes the colorant layer on each iron oxide grain uneven and thereby obstructs the dispersion of the grains into toner or, in the worst case, causes the composite iron oxide grains themselves to granulate.

The colorant should be used in an amount of 3 parts by weight to 20 parts by weight, preferably 5 parts by weight to 15 parts by weight, for the magnetic iron oxide grains. An amount below 5 parts by weight makes the coloring degree of the colorant and therefore image density short. An amount above 20 parts by weight lowers the fluidity of the magnetic grains and therefore the dispersibility of the magnetic grains during production. In addition, carbon black is apt to leave the magnetic grains and bring about background fog and other defects.

The silane coupler may be coated on the magnetic iron oxide grains by being sprayed while being agitated. The silane coupler used as a binder may be any one of, e.g., hexamethyldisilazane, trimethylsilane, trimethylchlorosilane, trimethyletoxysilane, dimethyldichrlorosilane, methyltrichlorosilane, aryldimethylchlorosilane, arylphenyldichlorosilane, benzilmethylchlorosilane, prommethyldimethylchlorosilane, α-chloroethyltrichlorosilane, β-chloroethyltrichlorosilane, chloromethyldimethylchlorosilane, triorganosilanemethyl captan, trimethylsilylcaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane and 1,3-diphenyltetramethyldisiloxane.

In the illustrative embodiment, the magnetic grains should preferably be implemented by magnetite, which is one of magnetic iron oxides, and may be produced by any one of conventional methods. A specific method consists in neutralizing an aqueous solution of iron sulfate with an alkaline aqueous solution to thereby produce iron, hydroxide, preparing an iron hydroxide suspension with pH of 10 or above, oxidizing the suspension with oxygen-containing gas to thereby prepare a magnetite slurry, and then rinsing, filtering, drying and pulverizing the slurry to thereby produce magnetite grains.

The ferromagnetic grains stated above should preferably not contain silica and should preferably be spherical. The mean grain size of the ferromagnetic grains should preferably be between 0.2 μm and 0.4 μm, more preferably between 0.2 μm and 0.3 μm, and should preferably be contained in the magnetic toner in an amount of 5 wt % to 80 wt %, more preferably 10 wt % to 30 wt %. While the magnetic grains may be octagonal, hexagonal, needle-like or scale-like, spherical grains that are little anisotropic are desirable.

Toner produced by any conventional method is also applicable to the illustrative embodiment. For example, toner can be produced by adding a colorant and a polarity control agent to a monomer produced by polymerization to thereby prepare a monomer composition, and polymerizing the monomer composition in a water-based medium by suspension. If desired, use may be made of emulsion polymerization.

Additives should preferably be added to the toner of the illustrative embodiment for enhancing development, fluidity, and durability. The additives include a fluidizing agent, e.g., grains of cerium oxide, zirconium oxide, silicon oxide, titanium oxide, aluminum oxide, zinc oxide, antimony oxide, tin oxide or similar metal oxide or silicon carbonate or silicon nitrate, and a cleaning assisting agent, e.g., fine grains of fluorocarbon resin, silicone resin or acrylic resin or zinc stearate, calcium stearate, aluminum stearate, magnesium stearate or similar lubricant based on metal soap. Among them, silicon oxide or titanium oxide and zinc stearate are desirable as a fluidizing agent and a cleaning assisting agent, respectively.

The fluidizing agent applicable to the illustrative embodiment should preferably be processed together with silicone varnish, modulated silicone varnish, silicone oil, modulated silicone oil, silane coupler with or without a functional group, any other organic silicon compound or similar processing agent.

The toner of the illustrative embodiment may contain any conventional parting agent so as to be easily parted in the event of fixation. For example, polypropylene of low molecular weight, microcrystalline wax, carnauba wax, sazol wax or paraffin wax or a derivative thereof should preferably be added in an amount of 0.1 wt % to 10 wt % for 100 wt % of binder resin.

A specific method of producing the two-ingredient type developer of the illustrative embodiment begins with mixing in a Henschel or similar mixer a mixture of the binder resin, colorant implemented by pigment or dye, charge control agent, lubricant and other additives. Subsequently, the mixture is sufficiently kneaded by any one of kneaders available on the market, cooled off, and then roughly pulverized by, e.g., a hammer mill. In the case of color toner, it is a common practice to improve the dispersibility of the pigment by kneading part of the binder resin and the pigment to prepare a master batch and use it as a colorant. Further, the roughly pulverized grains are finely pulverized by use of a pulverizer using a jet air stream or a mechanical pulverizer. The resulting fine grains are classified into preselected grain sizes by a classifier using a rotational air stream or the Coand effect. A classifier using the Coand effect is particularly suitable for the illustrative embodiment. Finally, the grains are sufficiently mixed with the fluidizing agent by a Henschel mixer or similar mixer and then passed to a screen of 250 mesh or above, whereby coarse grains and cohered grains are removed.

In the illustrative embodiment, the carrier grains have saturation magnetization of 30 emu/g to 120 emu/g in a magnetic field of 1,000 Oe, preferably 40 emu/g to 100 emu/g. Such saturation magnetization intensifies magnetic restraint urging the developer toward the sleeve 4 in the developing zone D and thereby effectively obviates the deposition of the carrier grains on the drum 1, insuring high image quality.

In the illustrative embodiment, if the carrier grains have a weight mean grain size of 20 μm to 100 μm, then the toner content of the developer layer can be increased in the developing zone D and implements sufficiently high image density even in conditions particular to a high-speed machine.

In the illustrative embodiment, the core of the individual carrier grain may be implemented by any conventional substance, e.g., iron, cobalt, nickel or similar ferromagnetic metal, magnetite, hematite, ferrite or similar alloy or compound thereof, or a composite thereof.

The carrier grains of the illustrative embodiment should preferably be coated with resin for enhancing durability. The resin may selected from a group of polyolefin resins including polyethylene, polypropylene, chlorinated polyethylene and chlorosulfonated polyethylene, a group of polyvinyl reins and polyvinylidene resins including polystyrene, acryl (e.g. polymethylmethacrylate), polyacrylonitril, polyvinyl acetate, polyvinyl alcohol, polyvinyl butyral, polyvinyl chloride, polyvinyl carbazole and polyvinyl ether, a group of vinyl chloride-vinyl eter copolymers, a group of silicone resins having organosiloxane bond and modifications thereof modulated by, e.g., alkyd resin, polyester resin, epoxy resin and polyurethane), a group of fluoric resins including polytetrafluoroethylene, polyvinyl fluoride, polyvinylidene fluoride and polychlorotrifluoroethylene, polyamide, polyester, polyurethane, polycarbonate, a group of amino resins including urea-formaldehyde resin, and epoxy resin. Among them, silicone resin or a modification thereof, fluorine resin, particularly silicone resin or a modification thereof, is desirable in the aspect of toner spent.

Silicone resin mentioned above may be any of conventional silicone resins, e.g., straight silicone including only organosiloxane bond, as represented by the formula (1) of FIG. 13, or silicone resin modulated by alkyd, polyester, epoxy or urethane.

In the illustrative embodiment, to control the specific volume resistivity of the carrier grains, a conduction agent may be dispersed in the coating layer. Use may be made of any conventional conduction agent, e g., iron, gold, copper or similar metal, ferrite, magnetite or similar iron oxide or carbon black or similar pigment. Particularly, when a combination of furnace black and acetylene black, which are specific forms of carbon black is used, it is possible to effectively adjust conductivity with a small amount of fine conductive grains and to provide the coating layer with high wear resistance. Such conductive grains should preferably have a grain size of about 0.01 μm to 10 μm and should preferably be added in an amount of 2 parts by weight to 30 parts by weight, more preferably 5 parts by weight to 20 parts by weight, for 100 parts by weight of the coating resin.

Further, a silane coupler or a titanium coupler may be added to the carrier coating layer in order to enhance adhesion of the coating layer to the core and promote the dispersion of the conduction agent. The silane coupler is a compound represented by the formula of FIG. 15. To form the coating layer, a coating layer forming liquid may be coated on the core by spraying, dipping or similar conventional method. The coating layer should preferably be 0.1 μm to 20 μm thick.

Hereinafter will be described specific procedures for producing the toner available with the illustrative embodiment and specific experiments.

Example 1

100 parts by weight of polyester resin, 5 parts by weight of carbon black, 3 parts by weight of chrome-containing azo dye and 70 parts by weight of fine magnetite grains were mixed together. The mixture had a mean grain size of 0.20 μm, an FeO content of 20 wt %, a specific surface area of 8.0 $m^2/g$ and magnetization strength of 61 emu/g. The mixture was mixed by a Henschel mixer, kneaded by a kneader, solidified by cooling, roughly pulverized by a cutter mill, finely pulverized by a mechanical mill, pulverized a jet mill via a multidivision classifier using the Coand effect, and classified to prepare mother grains having a mean grain size of 7.0 μm. 0.6 part by weight of hydrophobic coloidal silica and 0.3 part by weight of hydrophobic titanium oxide were added to 100 parts by weight of the mother grains and then mixed by a Henschel mixer to thereby produce toner grains a. The toner grains had saturation magnetization of 24 emu/g in a magnetic field of 1,000 Oe and had circularity of 0.943.

Examples 2 through 8

Examples 2 through 8 are identical with Example 1 except for the pulverizing condition. FIG. 23 shows toner grains b through h produced by Examples 2 through 8.

A specific procedure for producing the carrier grains will be described hereinafter. 2 parts by weight of polyvinyl alcohol and 60 parts by weight of water were introduced in a ball mill for 100 parts by weight of magnetite prepared by a wet process and then mixed for 12 hours so as to produce a magnetite slurry. The slurry was granulated by spraying to become spherical grains having a mean grain size of 54 μm. The grains were then baked at 1,000° C. for 3 hours in a nitrogen atmosphere and then cooled to produce core grains 1.

On the other hand, 100 parts by weight of a silicone resin solution, 100 parts by weight of toluene, 6 parts by weight of γ-aminopropyltrimethoxysilane and 10 parts by weight of carbon black were mixed for 20 minutes in a homomixer for preparing a coating layer forming liquid 1. The liquid 1 was coated on 1,000 parts by weight of the core grains 1 by a fluid-bed type coater to thereby produce carrier grains A coated with silicone resin. The carrier grains A had a mean grain size of 58 μm and saturation magnetization of 65 emu/g.

METHOD OF PRODUCING DEVELOPER

The developer may be produced by the following specific method. 10 parts by weight of the toner grains a were added to 100 parts by weight of the carrier grains A and then mixed by a turbuler mixer to produce a developer 1 (Example 1). In the same manner, developers shown in FIG. 24 were produced by various toner and Carrier combinations.

Specific experiments and results thereof will be described hereinafter.

Experiment 1

Experiment 1 was also conducted in the conditions shown in FIG. 18 by using the gauss meter HGM 8300 and axial probe Type A1 available from ADS and a circle chart recorder. This is also true with the other experiments.

Under the conditions shown in FIG. 24 relating to Developers 1 through 8, the attenuation ratio (%) of the peak value of the normal flux density was varied to measure the amount of omission of a trailing edge to occur in a halftone solid image and the ratio in width between a horizontal line and a vertical line.

FIG. 25 shows the results of Experiment 1. As shown, as for the omission of the trailing edge, double circles and circles are representative of amounts of omission between 0 mm and 0.4 mm that are desirable. Crosses and triangles are representative or amounts of omission of 0.8 mm and above and medium amounts of omission, respectively.

To determine the ratio in width between a horizontal line and a vertical line, images corresponding horizontal lines and vertical lines of the same width included in a document were formed. The ratio was produced by dividing the width of output vertical lines (extending in the direction of movement of the sleeve) by the width of output horizontal lines (extending in the axial direction of the sleeve); the greater the ratio, the more the horizontal lines are thinned. In FIG. 25, double circles and circles are representative of ratios of 1±0.2 that render the difference between the vertical line and the horizontal line inconspicuous. Triangles are representative of ratios between 1.2 and 1.25 (or 0.75 and 0.80) while crosses are representative of ratios of 1.26 and above (or 0.74 and below).

As for image density controllability, twenty solid images having an area ratio of 100% each were continuously output in order to estimate the resulting difference in image density. In FIG. 25, double circles and circles are representative of differences of less than 0.1 and differences of 0.1 and above, but below 0.2, respectively. Triangles and crosses are representative of differences of 0.2 and above, but below 0.5, and differences of 0.5 and above, respectively.

To determine the irregularity of image density, image density was measured by a Macbeth densitometer at three positions of the upper, middle and lower portions of an image, i.e., nine positions in total, and then a difference between the maximum density and the minimum density was determined to be irregularity. Double circles are representative of irregularity of less than 0.1 while circles are representative of irregularity of 0.1 and above, but below 0.2. Triangles and crosses are representative of irregularity of 0.2 and above, but below 0.5, and irregularity of 0.5 and above, respectively.

As FIG. 25 indicates, when use is made of magnetic toner grains whose circularity is 0.93 or above and when the attenuation ratio of the peak value of the normal flux density Bn is 50% or above, it is possible to reproduce reduce the degree of the omission and thinning of horizontal lines, and implement desirable image density controllability and irregularity.

Experiment 2

Experiment 2 was conducted with the developer 1 under the conditions of FIG. 18 by varying the angle θ1 between the pole transition points where the flux density is 0 mT. The results of experiments were shown in FIG. 26. As FIG. 26 indicates, when the circularity is 0.93 or above and when the angle θ1 is 40° or below, the magnetic toner grains 3*a* can reduce the degree of the omission and thinning of horizontal lines, and implement desirable image density controllability and irregularity.

Experiment 3

Experiment 3 was conducted with the developers 1 through 8 under the conditions of FIG. 18 by varying the half-value angle θ2 of the normal flux density distribution. The results of experiments were shown in FIG. 21. As FIG. 27 indicates, when the circularity is 0.93 or above and when the angle θ2 is 20° or below, the magnetic toner grains 3*a* can reduce the degree of the omission and thinning of horizontal lines, and implement desirable image density controllability and irregularity.

The illustrative embodiment may also be constructed into the specific image forming process cartridge shown in FIG. 22.

As stated above, the illustrative embodiment reduces toner scattering and omission and other image defects despite the use of spherical magnetic toner grains when the linear velocity of the developer carrier is high.

While the illustrative embodiments have concentrated on direct image transfer of a toner image from an image carrier to a sheet, the present invention is similarly applicable to an image forming apparatus of the type transferring a toner image from an image carrier to a sheet by way of an intermediate image transfer body implemented as, e.g., a belt. This type of image forming apparatus may be implemented as a color image forming apparatus or a tandem, color image forming apparatus well known in the art. Of course, the present invention is applicable not only to a printer and a developing device thereof shown and described, but also to any other image forming apparatus, e.g., copier and a developing device thereof.

Various modifications will become possible for those skilled in the art after receiving the teachings of the present disclosure without departing from the scope thereof.

What is claimed is:

1. In a developing device comprising a developer carrier whose surface moves with a developer consisting of toner grains and magnetic grains deposited thereon, where an adjacent image carrier whose surface moves with a latent image formed thereon, and a magnetic pole facing a developing zone where said developer carrier and said image carrier face each other, causing said developer to rise in a form of a magnet brush on said developer carrier in said developing zone due to a force of said magnetic pole, and causing said surface of said developer carrier to move in a same direction as, but at a higher linear velocity than, said surface of said image carrier in said developing zone to thereby cause said magnet brush to rub said surface of said image carrier and develop said latent image, the toner grains comprise magnetic grains consisting of at least binder resin and a magnetic substance, flux density formed by said magnetic pole in a direction normal to the surface of said developer carrier outside of said surface has an attenuation ratio of 50 or above, the magnetic toner grains have a weight mean grain size of 6.0 μm to 8.0 μm, and the magnetic toner grains having a grain size of 5 μm or below are contained in the developer by 40% to 80% and have magnetization strength of 10 emu/g to 25 emu/g in a magnetic field of 5 kOe or magnetization strength of 7 emu/g to 20 emu/g in a magnetic field of 1 kOe.

2. The developing device as claimed in claim 1, wherein said developing device comprise:

a metering member for regulating an amount of the developer deposited on said developer carrier and being conveyed toward the developing zone;

a developer chamber storing part of the developer blocked by said metering member; and a toner hopper facing the surface of said developer carrier at a position where said toner hopper adjoins said developer chamber from an upstream side in a direction of developer conveyance; and the developer moving on said developer carrier automatically takes in fresh toner stored in said toner hopper in accordance with a toner content of said developer.

3. In a developing device comprising a developer carrier whose surface moves with a developer consisting of toner grains and magnetic grains deposited thereon, where an adjacent image carrier whose surface moves with a latent image formed thereon and a magnetic pole facing a developing zone where said developer carrier and said image carrier face each other, causing said developer to rise in a form of a magnet brush on said developer carrier in said developing zone due to a force of said magnetic pole, and causing said surface of said developer carrier to move in a same direction as, but at a higher linear velocity than, said surface of said image carrier in said developing zone to thereby cause said magnet brush to rub said surface of said image carrier and develop said latent image, the toner grains comprise magnetic grains consisting of at least binder resin and a magnetic substance, when opposite pole transition points where flux density generated by said magnetic pole in a direction normal to the surface of said developer carrier outside of said surface is 0 mT are seen from an axis of curvature of the surface of said developer carrier in the developing zone, an angle between said magnetic pole transition points is 40° or below, the magnetic toner grains have a weight mean grain size of 6.0 μm to 8.0 μm, and the magnetic toner grains having a grain size of 5 μm or below are contained in the developer by 40% to 80% number % and have magnetization strength of 10 emu/g to 25 emu/g in a magnetic field of 5 kOe or magnetization strength of 7 emu/g to 20 emu/g in a magnetic field of 1 kOe.

4. The developing device as claimed in claim 3, wherein said developing device comprise:

a metering member for regulating an amount of the developer deposited on said developer carrier and being conveyed toward the developing zone;

a developer chamber storing part of the developer blocked by said metering member; and a toner hopper facing the surface of said developer carrier at a position where said toner hopper adjoins said developer chamber from an upstream side in a direction of developer conveyance; and the developer moving on said developer carrier automatically takes in fresh toner stored in said toner hopper in accordance with a toner content of said developer.

5. In a developing device comprising a developer carrier whose surface moves with a developer consisting of toner grains and magnetic grains deposited thereon, where an adjacent image carrier whose surface moves with a latent image formed thereon and a magnetic pole facing a developing zone where said developer carrier and said image carrier face each other, causing said developer to rise in a form of a magnet brush on said developer carrier in said developing zone due to a force of said magnetic pole, and causing said surface of said developer carrier to move in a same direction as, but at a higher linear velocity than, said surface of said image carrier in said developing zone to thereby cause said magnet brush to rub said surface of said image carrier and develop said latent image, the toner grains comprise magnetic grains consisting of at least binder resin and a magnetic substance, when opposite points where flux density generated by said magnetic pole in a direction normal, to the surface of said developer carrier outside of said surface is one-half of a maximum flux density are seen from an axis of curvature of the surface of said developer carrier in the developing zone, an angle between said points is 20° or below, the magnetic toner grains have a weight mean grain size of 6.0 μm to 8.0 μm, and the magnetic toner grains having a grain size of 5 μm or below are contained in the developer by 40% to 80 number % and have magnetization strength of 10 emu/g to 25 emu/g in a magnetic field of 5 kOe or magnetization strength of 7 emu/g to 20 emu/g in a magnetic field of 1 kOe.

6. The developing device as claimed in claim 5, wherein said developing device comprise:

a metering member for regulating an amount of the developer deposited on said developer carrier and being conveyed toward the developing zone;

a developer chamber storing part of the developer blocked by said metering member; and a toner hopper facing the surface of said developer carrier at a position where said toner hopper adjoins said developer chamber from an upstream side in a direction of developer conveyance; and the developer moving on said developer carrier automatically takes in fresh toner stored in said toner hopper in accordance with a toner content of said developer.

7. An image forming apparatus comprising:

an image carrier;

latent image forming means for forming a latent image on said image carrier;

developing means for developing the latent image with a developer, which consists of toner grains and magnetic grains, to thereby produce a corresponding toner image; and image transferring means for transferring the toner image from said latent image carrier to a recording medium;

said developing means comprising a developer carrier whose surface moves with the developer deposited thereon and a magnetic pole facing a developing zone where said developer carrier faces said image carrier, causing said developer to rise in a form of a magnet brush on said developer carrier in said developing zone due to a force of said magnetic pole, and causing said surface of said developer carrier to move in a same direction as, but at a higher linear velocity than, a surface of said image carrier in said developing zone to thereby cause said magnet brush to rub said surface of said image carrier and develop the latent image;

wherein the toner grains comprise magnetic grains consisting of at least binder resin and a magnetic substance, flux density formed by said magnetic pole in a direction normal to the surface of said developer carrier outside of said surface has an attenuation ratio of 50% or above, the magnetic toner grains have a weight mean grain size of 6.0 μm to 8.0 μm, and the magnetic toner grains having a grain size of 5 μm or below are contained in the developer by 40% to 80% and have magnetization strength of 10 emu/g to 25 emu/g in a magnetic field of 5 kOe or magnetization strength of 7 emu/g to 20 emu/g in a magnetic field of 1 kOe.

8. The apparatus as claimed in claim 7, wherein said developing device comprise:

a metering member for regulating an amount of the developer deposited on said developer carrier and being conveyed toward the developing zone;

a developer chamber storing part of the developer blocked by said metering member; and a toner hopper facing the surface of said developer carrier at a position where said toner hopper adjoins said developer chamber from an upstream side in a direction of developer conveyance; and the developer moving on said developer carrier automatically takes in fresh toner stored in said toner hopper in accordance with a toner content of said developer.

9. An image forming apparatus comprising:

an image carrier;

latent image forming means for forming a latent image on said image carrier;

developing means for developing the latent image with a developer, which consists of toner grains and magnetic grains, to thereby produce a corresponding toner image; and image transferring means for transferring the toner image from said latent image carrier to a recording medium;

said developing means comprising a developer carrier whose surface moves with the developer deposited thereon and a magnetic pole facing a developing zone where said developer carrier faces said image carrier, causing said developer to rise in a form of a magnet brush on said developer carrier in said developing zone due to a force of said magnetic pole, and causing said surface of said developer carrier to move in a same direction as, but at a higher linear velocity than, a surface of said image carrier in said developing zone to thereby cause said magnet brush to rub said surface of said image carrier and develop the latent image;

wherein the toner grains comprise magnetic grains consisting of at least binder resin and a magnetic substance, when opposite pole transition points where flux density generated by said magnetic pole in a direction normal to the surface of said developer carrier outside of said surface is 0 mT are seen from an axis of curvature of the surface of said developer carrier in the developing zone, an angle between said magnetic pole transition points is 40° or below, the magnetic toner grains have a weight mean grain size or 6.0 $\mu$m to 8.0 $\mu$m, and the magnetic toner grains having a grain size of 5 $\mu$m or below are contained in the developer by 40% to 80% and have magnetization strength of 10 emu/g to 25 emu/g in a magnetic field of 5 kOe or magnetization strength of 7 emu/g to 20 emu/g in a magnetic field of 1 kOe.

10. The apparatus as claimed in claim 7, wherein said developing device comprises:

a metering member for regulating an amount of the developer deposited on said developer carrier and being conveyed toward the developing zone;

a developer chamber storing part of the developer blocked by said metering member; and a toner hopper facing the surface of said developer carrier at a position where said toner hopper adjoins said developer chamber from an upstream side in a direction of developer conveyance; and the developer moving on said developer carrier automatically takes in fresh toner stored in said toner hopper in accordance with a toner content of said developer.

11. An image forming apparatus comprising:

an image carrier;

latent image forming means for forming a latent image on said image carrier;

developing means for developing the latent image with a developer, which consists of toner grains and magnetic grains, to thereby produce a corresponding toner image; and image transferring means for transferring the toner image from said latent image carrier to a recording medium;

said developing means comprising a developer carrier whose surface moves with the developer deposited thereon and a magnetic pole facing a developing zone where said developer carrier faces said image carrier, causing said developer to rise in a form of a magnet brush on said developer carrier in said developing zone due to a force of said magnetic pole, and causing said surface of said developer carrier to move in a same direction as, but at a higher linear velocity than, a surface of said image carrier in said developing zone to thereby cause said magnet brush to rub said surface of said image carrier and develop the latent image;

wherein the toner grains comprise magnetic grains consisting of at least binder resin and a magnetic substance, when opposite points where flux density generated by said magnetic pole in a direction normal to the surface of said developer carrier outside of said surface is one-half of a maximum flux density are seen from an axis of curvature of the surface of said developer carrier in the developing zone, an angle between said points is 20° or below, the magnetic toner grains have a weight mean grain size of 6.0 $\mu$m to 8.0 $\mu$m, and the magnetic toner grains having a grain size of 5 $\mu$m or below are contained in the developer by 40% to 80 number % and have magnetization strength of 10 emu/g to 25 emu/g in a magnetic field of 5 kOe or magnetization strength of 7 emu/g to 20 emu/g in a magnetic field of 1 kOe.

12. The apparatus as claimed in claim 11, wherein said developing device comprises:

a metering member for regulating an amount of the developer deposited on said developer carrier and being conveyed toward the developing zone;

a developer chamber storing part of the developer blocked by said metering member; and a toner hopper facing the surface of said developer carrier at a position where said toner hopper adjoins said developer chamber from an upstream side in a direction of developer conveyance; and the developer moving on said developer carrier automatically takes in fresh toner stored in said toner hopper in accordance with a toner content of said developer.

13. In an image forming process unit removable from a body of an imager forming apparatus and comprising at least one of an image carrier, charging means for uniformly charging a surface of said image carrier and cleaning means for cleaning said surface of said image carrier and developing means for developing a latent image formed on said image carrier with a developer, which consists of toner grains and carrier grains, to thereby produce a corresponding toner image, said developing means comprises a developer carrier whose surface moves with the developer deposited thereon and a magnetic pole facing a developing zone where said developer carrier faces said image carrier, causes said developer to rise in a form of a magnet brush on said developer carrier in said developing zone due to a force of said magnetic pole, and causes said surface of said developer carrier to move in a same direction as, but at a higher linear velocity than, a surface of said image carrier in said developing zone to thereby cause said magnet brush to rub said surface of said image carrier and develop the latent image, the toner grains comprise magnetic grains consisting of at least binder resin and a magnetic substance, flux density formed by said magnetic pole in a direction normal to the surface of said developer carrier outside of said surface has an attenuation ratio of 50% or above, the magnetic toner grains have a weight mean grain size of 6.0 $\mu$m to 8.0 $\mu$m, and the magnetic toner grains having a grain size of 5 $\mu$m or below are contained in the developer by 40% to 80 number % and have magnetization strength of 10 emu/g to 25 emu/g in a magnetic field of 5 kOe or magnetization strength of 7 emu/g to 20 emu/g in a magnetic field of 1 kOe.

14. The process unit as claimed in claim 13, wherein said developing means comprises:

a metering member for regulating an amount of the developer deposited on said developer carrier and being conveyed toward the developing zone;

a developer chamber storing part of the developer blocked by said metering member; and a toner hopper facing the surface of said developer carrier at a position where said toner hopper adjoins said developer chamber from an upstream side in a direction of developer conveyance; and the developer moving on said developer carrier automatically takes in fresh toner stored in said toner hopper in accordance with a toner content of said developer.

15. In an image forming process unit removable from a body of an image forming apparatus and comprising at least one of an image carrier, charging means for uniformly charging a surface of said image carrier and cleaning means for cleaning said surface of said image carrier and developing means for developing a latent image formed on said image carrier with a developer, which consists of toner grains and carrier grains, to thereby produce a corresponding toner image, said developing means comprises a developer carrier whose surface moves with the developer deposited thereon and a magnetic pole facing a developing zone where said developer carrier faces said image carrier, causes said developer to rise in a form of a magnet brush on said developer carrier in said developing zone due to a force of said magnetic pole, and causes said surface of said developer carrier to move in a same direction as, but at a higher linear velocity than, a surface of said image carrier in said developing zone to thereby cause said magnet brush to rub said surface of said image carrier and develop the latent image, the toner grains comprise magnetic grains consisting of at least binder resin and a magnetic substance, when opposite pole transition points where flux density generated by said magnetic pole in a direction normal to the surface of said developer carrier outside of said surface is 0 mT are seen from an axis of curvature of the surface of said developer carrier in the developing zone, an angle between said magnetic pole transition points is 40° or below, the magnetic toner grains have a weight mean grain size of 6.0 $\mu$m to 8.0 $\mu$m, and the magnetic toner grains having a grain size of 5 $\mu$m or below are contained in the developer by 40% to 80 number % and have magnetization strength of 10 emu/g to 25 emu/g in a magnetic field of 5 kOe or magnetization strength of 7 emu/g to 20 emu/g in a magnetic field of 1 kOe.

16. The process unit as claimed in claim 15, wherein said developing means comprises:

a metering member for regulating an amount of the developer deposited on said developer carrier and being conveyed toward the developing zone;

a developer chamber storing part of the developer blocked by said metering member; and a toner hopper facing the surface of said developer carrier at a position where said toner hopper adjoins said developer chamber from an upstream side in a direction of developer conveyance; and the developer moving on said developer carrier automatically takes in fresh toner stored in said toner hopper in accordance with a toner content of said developer.

17. In an image forming process unit removable from a body of an image forming apparatus and comprising at least one of an image carrier, charging means for uniformly charging a surface of said image carrier and cleaning means for cleaning said surface of said image carrier and developing means for developing a latent image formed on said image carrier with a developer, which consists of toner grains and carrier grains, to thereby produce a corresponding toner image, said developing means comprises a developer carrier whose surface moves with the developer deposited thereon and a magnetic pole facing a developing zone where said developer carrier faces said image carrier, causes said developer to rise in a form of a magnet brush on said developer carrier in said developing zone due to a force of said magnetic pole, and causes said surface of said developer carrier to move in a same direction as, but at a higher linear velocity than, a surface of said image carrier in said developing zone to thereby cause said magnet brush to rub said surface of said image carrier and develop the latent image, the toner grains comprise magnetic grains consisting of at least binder resin and a magnetic substance, when opposite points where flux density generated by said magnetic pole in a direction normal to the surface of said developer carrier outside of said surface is one-half of a maximum flux density are seen from an axis of curvature of the surface of said developer carrier in the developing zone, an angle between said points is 20° or below, the magnetic toner grains have a weight mean grain size of 6.0 $\mu$m to 8.0 $\mu$m, and the magnetic toner grains having a grain size of 5 $\mu$m or below are contained in the developer by 40% to 80 number % and have magnetization strength of 10 emu/g to 25 emu/g in a magnetic field of 5 kOe or magnetization strength of 7 emu/g to 20 emu/g in a magnetic field of 1 kOe.

18. The process unit as claimed in claim 17, wherein said developing means comprises:

a metering member for regulating an amount of the developer deposited on said developer carrier and being conveyed toward the developing zone;

a developer chamber storing part of the developer blocked by said metering member; and a toner hopper facing the surface of said developer carrier at a position where said toner hopper adjoins said developer chamber from an upstream side in a direction of developer conveyance; and the developer moving on said developer carrier automatically takes in fresh toner stored in said toner hopper in accordance with a toner content of said developer.

* * * * *